US007219828B2

(12) United States Patent
Lombardo

(10) Patent No.: US 7,219,828 B2
(45) Date of Patent: May 22, 2007

(54) CROSS FOLDED, PRESSURE SEALED MULTI-PAGE PAPER ASSEMBLY AND METHODS OF MAKING SAME

(75) Inventor: Leo Lombardo, Manchester, NH (US)

(73) Assignee: Infoseal L.L.C., Englewood, NJ (US)

( * ) Notice: Subject to any disclaimer, the term of this patent is extended or adjusted under 35 U.S.C. 154(b) by 320 days.

(21) Appl. No.: 10/693,821

(22) Filed: Oct. 24, 2003

(65) Prior Publication Data

US 2004/0140344 A1 Jul. 22, 2004

Related U.S. Application Data

(60) Provisional application No. 60/420,814, filed on Oct. 25, 2002.

(51) Int. Cl.
*B65D 27/00* (2006.01)

(52) U.S. Cl. ..... 229/92.1; 229/70

(58) Field of Classification Search ..... 229/92.1, 229/70

See application file for complete search history.

(56) References Cited

U.S. PATENT DOCUMENTS 5,046,661 A * 9/1991 Kimura ..... 229/92.1
5,174,491 A * 12/1992 Taylor et al. ..... 229/92.1
5,360,159 A * 11/1994 Perriman ..... 229/92.3
5,829,670 A * 11/1998 Lombardo et al. ..... 229/92.1
6,126,064 A * 10/2000 Hutchinson ..... 229/92.1
6,131,802 A * 10/2000 Lombardo ..... 229/92.1

* cited by examiner

*Primary Examiner*—Jes F. Pascua
(74) *Attorney, Agent, or Firm*—Mintz, Levin, Cohn, Ferris, Glovsky and Popeo, P.C.

(57) ABSTRACT

A cost effective, pressure-sealed, multi-page paper assembly is configured as a mailer-type of assembly for use as a business form, direct mail piece or other document to distribute information to end-users. The multi-page paper assembly is formed from a single ply or sheet of paper that permits use of such cost-saving technologies as laser printing and imaging of the single ply or sheet. The multi-page paper assembly includes a central transverse line of cross fold perforations and a plurality of lines of fold assist perforations that permit the single ply or sheet to be folded into a desired Z-fold, C-fold, eccentric C-fold, V-fold, double parallel-fold or other folded configuration having a number of inboard panels to serve as pages of the assembly. Deposits of pressure-activated cohesive along one or both surfaces of the single ply or sheet are placed to define those panels to serve as inboard boards and to adhere portions of the ply or sheet when folded. Cohesive deposits can form seals and thereby a secure seal multi-page paper assembly when pressure-sealed to protect contents. Use of low-tack deposits can form unsecured seals for use with direct mail pieces. Removal of stub portions of the paper assembly permits the sealed assembly to be opened in a book-like manner along the sealed cross fold perforations and access provided to the multiple of pages contained therein.

12 Claims, 19 Drawing Sheets

CROSS FOLDED, PRESSURE SEALED MULTI-PAGE PAPER ASSEMBLY AND METHODS OF MAKING SAME

PRIOR RELATED PATENT APPLICATIONS

The present invention claims priority under 37 C.F.R. § 119(e) to U.S. provisional patent application Ser. No. 60/420,814, filed on Oct. 25, 2002, which is incorporated herein by reference.

FIELD OF THE INVENTION

The invention relates to a multi-page paper assembly.

BACKGROUND OF THE INVENTION

Multi-page paper assemblies, such as mailer-type assemblies, used for business forms, direct mail pieces, information and promotional booklets, and other multi-page volumes are formed to distribute and supply information and/or instruments, e.g., having a certain dollar value, to end users. Such multi-page paper assemblies are typically constructed of a multiple of plies or sheets of suitable paper. The multiple plies or sheets of paper are typically printed, imaged or otherwise processed to dispose data and information on one or more surfaces of each ply or sheet. Thereafter, the multiple of plies or sheets are typically collated, stacked and joined, e.g., adhered or bound by adhesive or cohesive, along at least one longitudinal or one transverse edge to form a binder. The binder permits the multiple plies or sheets to be held together as an assembly and to configure the assembly in a book like manner. The plies or sheets of paper serve as pages of the assembly and can be readily accessible to an end user. Such an assembly can be further configured to provide a sealed assembly whereby adhesive or cohesive can be deposited on each ply or sheet at certain locations to join or seal adjacent pages, and in some cases to seal the assembly around its perimeter. Such sealed, multi-page sealed assemblies can be distributed to end users by hand and/or by mailing through the U.S. Postal Service.

Printing and binding multiple plies or sheets of paper suitable for forming a multi-page assembly includes a number of steps such as printing each surface of each ply or sheet, depositing sufficient adhesive or cohesive along certain portions of the plies or sheets and collating and binding the multiple of plies and sheets such that the completed assembly is bound and opens in a book like manner. Multiple process steps and plies or sheets of paper required to form a sealed, multi-page assembly, as described, contribute to the overall manufacturing costs and time to produce such an assembly and, hence, can increase the expense of producing this type of multi-page document. Thus, it is desirable to provide a sealed, multi-page paper assembly configured as a mailer type of assembly that is produced with less materials and by a reduced number of process steps, e.g., by permitting the use of laser printing or imaging techniques, such that manufacturing time and costs are reduced and a cost effective sealed, multi-page document is provided.

SUMMARY OF THE INVENTION

The invention provides a sealed, multi-page paper assembly constructed from a single ply or sheet of paper and is suitable for use as a mailer type business form or direct mail piece.

In one aspect of the invention a multi-page paper assembly includes a folded and sealed single ply of paper having a length and a width. The folded and sealed paper ply defines a first horizontal edge and a second horizontal edge opposite and parallel to the first horizontal edge along its length, and a first vertical edge and a second vertical edge opposite and parallel to the first vertical edge along its width. The assembly further includes a horizontal line of tear-off perforations configured along and adjacent each of the first and the second horizontal edges to define a horizontal stub portion, and a vertical line of tear-off perforations configured along and adjacent the first vertical edge to define a vertical stub portion, wherein the removal of the horizontal stub portions by tearing the paper ply along the horizontal lines of tear-off perforations and removal of the vertical stub portion by tearing the paper ply along the vertical line of tear-off perforations permits the folded and sealed single ply of paper to open from the vertical edge and the first and the second horizontal edges and along the second vertical edge in a book like manner and to permit access to a multiple of pages contained therein.

Implementations of the invention may include one or more of the following features. The assembly can include a line of tear-off perforations defined along a width of each page adjacent to the second vertical edge to permit the page to be torn along the line of tear-off perforations to remove the page from the assembly when open.

Another aspect of the invention a multi-page paper assembly includes a folded and sealed single ply of paper having a length and a width. The folded and sealed paper ply defines a first horizontal edge and a second horizontal edge opposite and parallel to the first horizontal edge along its length, a first vertical edge and a second vertical edge opposite and parallel to the first vertical edge along its width, and a vertical line of tear-off perforations configured along and adjacent the first vertical edge to define a vertical stub portion, wherein removal of the vertical stub portion by tearing the paper ply along the vertical line of tear-off perforations removes deposits of cohesive disposed on interior surfaces of the paper ply disposed along and adjacent the first and the second horizontal edges and the first vertical edge such that the paper ply opens from the first vertical edge and the first and the second horizontal edges and permits the paper ply to open in a book like manner to permit access to a multiple of pages contained therein.

Various aspects of the invention may provide one or more of the following advantages. A sealed, multi-page paper assembly can be constructed from a single ply or sheet of paper using pressure activated-sealing methods to form a mailer-type of business form, brochure or direct mail piece suitable for distribution by such delivery methods as the U.S. Postal Service. A cost effective sealed, multi-page paper assembly can be formed from a single ply or sheet of paper, eliminating the need for multiple plies or sheets to form a multi-page document or booklet. Use of a single ply or sheet of paper to form a sealed multi-page assembly or booklet can reduce manufacturing time and costs, e.g., to print, collate and bind a multiple of plies or sheets of paper. In addition, using a single ply or sheet of paper to form the multi-page assembly permits use of laser printing or imaging methods, which typically permit only a single ply or sheet to be processed at a time without manufacturing problems, to print data and information on surfaces of the assembly. The single sheet of paper can be folded by a folding process, e.g., mechanically or manually by hand, that includes cross folding the single sheet transversely and along certain longitudinal lines to produce the multiple pages of the assembly. The multiple pages can be removable where portions of the single ply or sheet of paper define lines of tear-off perforations. Deposits of pressure-activated cohesive can be disposed along certain portions of the single sheet that bind or adhere the folded portions of the assembly. Once folded, the assembly can be pressure sealed by any process known in the art that applies pressure to the folded assembly to activate cohesive deposits and to create a bond between folded portions to thereby form the sealed assembly. Some embodiments of the invention include deposits of cohesive that permit the single ply or sheet of paper to be folded and sealed to form a secure multi-page paper assembly that protects the contents of the assembly and/or helps to maintain confidentiality of the data and information provided therein. Some embodiments of the invention include deposits of low tack cohesive, wherein low tack cohesive refers to cohesive that forms less aggressive bonds such that some of the sealed portions of the assembly adhered by low tack cohesive can be readily and easily pulled or peeled apart to separate such portions. Such embodiments of the invention can be used to form a direct mail piece, an advertising brochure, a promotional free coupon booklet and other similar configurations. The multiple pages of the secured paper assembly can be accessible to a user when the user removes certain removable perforated perimeter portions, e.g., one or more horizontal and/or vertical stub portions, of the assembly and opens the assembly in a book like manner. The user can tear a page along an associated line of tear-off perforations to remove the page from the booklet.

The sealed multi-page mailer-type of paper assembly can be formed as a Z-fold, C-fold, eccentric C-fold, eccentric C-fold, eccentric C-fold, V-fold or double parallel-fold business form or direct mail piece by folding the single ply or sheet in half along a central transverse cross fold line of perforations and further folding the sheet along certain longitudinal fold assist lines of perforations according to methods and standards known in the art to fold and to achieve such varieties of folded configurations.

These and other advantages of the invention, along with the invention itself, will be more fully understood after a review of the following figures, detailed description and claims.

BRIEF DESCRIPTION OF THE DRAWINGS

FIG. 15 is a perspective view of the sealed multi-page assembly formed by Z-folding the single ply or sheet of paper shown in FIGS. 12 and 13.

DETAILED DESCRIPTION OF THE PREFERRED EMBODIMENTS

At least some embodiments of the invention provide a cross folded, pressure sealed multi-page paper assembly. Embodiments of the invention provide a multi-page paper assembly for use as, e.g., a business form or a direct mail piece, where the assembly is a one-piece assembly constructed of a single ply or sheet of paper, and is folded and sealed according to the invention to provide a multi-page assembly or booklet. The paper assembly has a center transverse line of cross fold perforations and one or more longitudinal fold lines of perforations to assist folding the single sheet assembly into a desired number of panels. The assembly further includes a plurality of deposits of pressure-activated cohesive disposed along at least one surface of the assembly to bind or adhere folded portions of the assembly. The center transverse line of cross fold perforations and certain cohesive deposits form a secure binder when the assembly is folded along the cross fold perforations such that the assembly may open in a book line manner along the binder. Placement of the central cross fold perforations and the cohesive deposits along the surfaces of the assembly depends on the number of panels and the type of folded configuration the assembly will embody, such as a Z-fold, C-fold, eccentric C-fold, V-fold or double-parallel fold assembly. In addition, placement of the fold line perforations, as well as other lines of perforations, and placement of the cohesive deposits is critical to proper alignment of perforations and cohesive deposits required during folding and sealing processes to effectively seal the assembly. When the assembly is folded in accordance with the invention, certain lines of perforations align with other lines of perforations to fold the assembly in a desired manner, and certain cohesive deposits align with other cohesive deposits to adhere the folded portions of the assembly. The folded assembly is thereafter pressure sealed by a suitable pressure sealing method well known in the art. The sealed assembly according to the invention is suitable for distribution by any of a variety of methods including mailing through the U.S. Postal Service. Some embodiments of the invention provide a secure sealed assembly having a secure seal to insure document security and, in some cases, confidentiality of the data and information contained within the assembly. Removing one or more vertical and/or one or more horizontal stub portions of the secure sealed assembly along lines of tear-off perforations permits the assembly to be opened as a multi-page booklet and to provide access to data and information contained therein. Some embodiments of the invention provide an unsecured sealed assembly, e.g., a direct mail or advertising piece, having a less aggressive seal that permits easy opening of the assembly by pulling or peeling pages apart to separate and to remove pages from the assembly. Other embodiments are within the scope and spirit of the invention.

Figure 1:
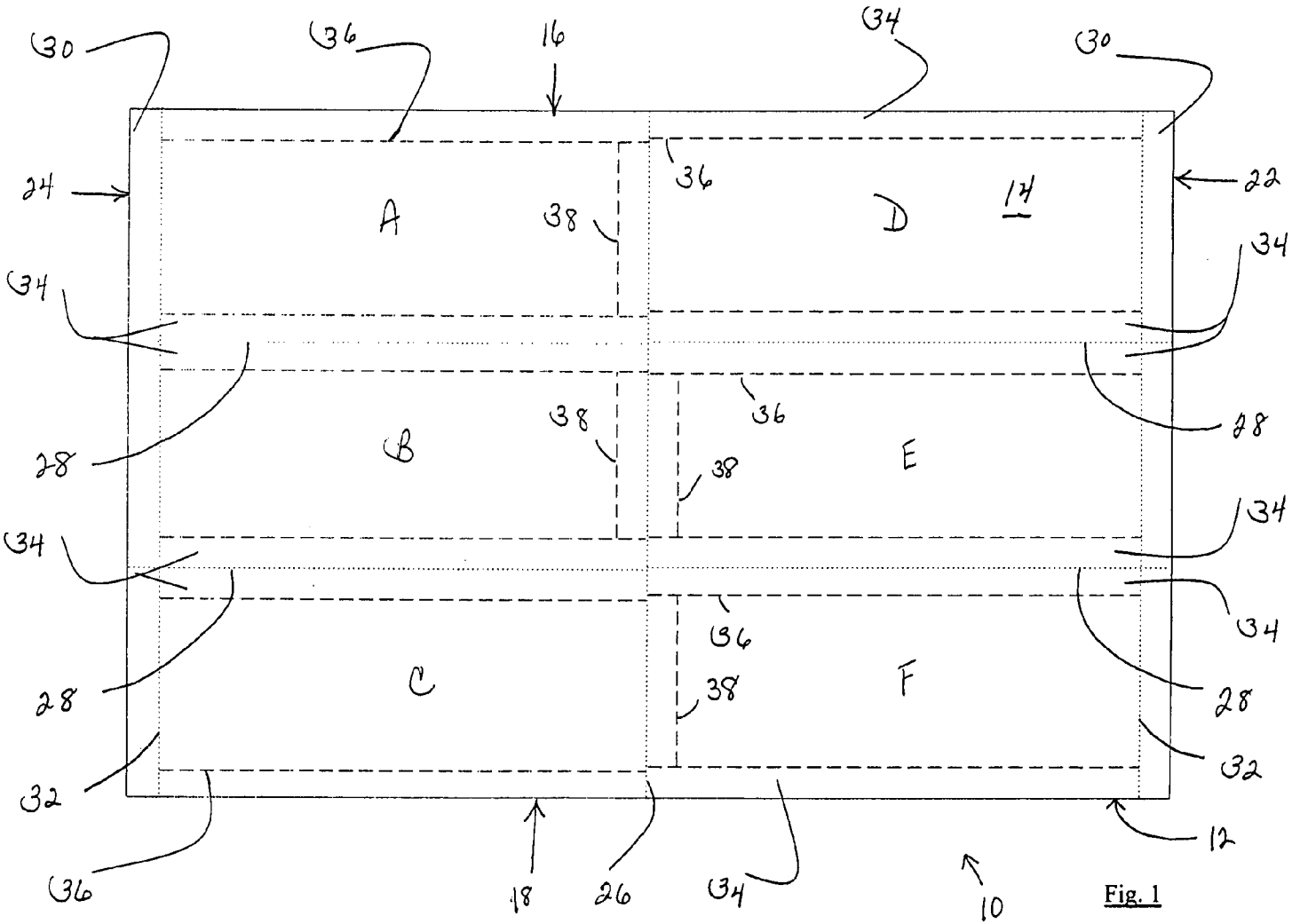
FIG. 1 is a perspective view of a first or face surface of a single ply or sheet of paper used to form one embodiment of a sealed multi-page paper assembly according to the invention.
Figure 2:
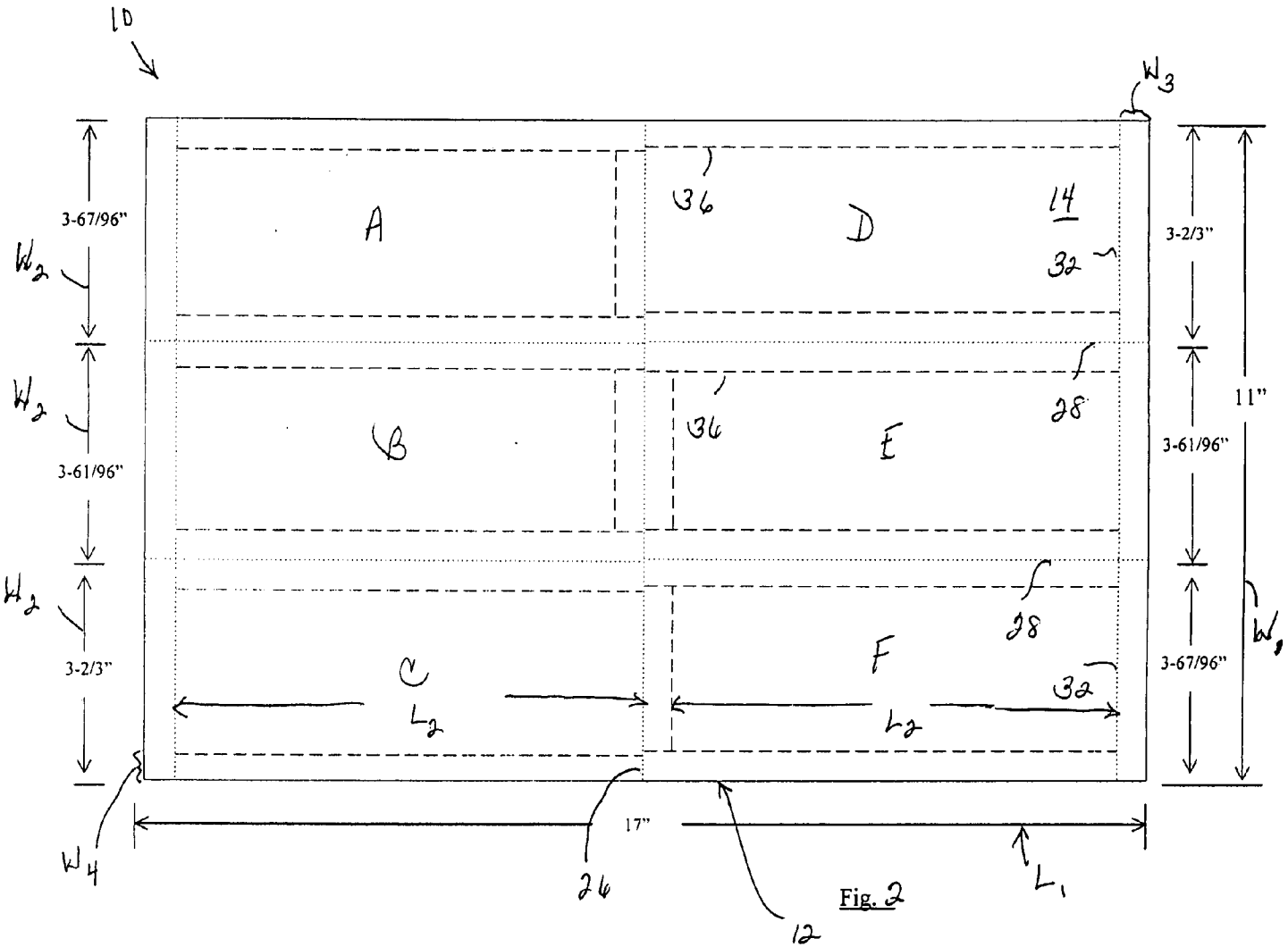
FIG. 2 is a perspective view of the first or face surface shown in FIG. 1 illustrating dimensions.

Referring to FIGS. 1 and 2, one embodiment of an assembly 10 according to the invention includes a secure, multi-page paper assembly 10. As used herein to disclose the invention, the term "secured" refers to the secure seal that deposits of pressure-activated cohesive provide to bind or adhere the folded assembly 10 such that contents of the assembly 10 remain secure during further processing and/or distribution of the assembly 10, for instance, by mail through the U.S. Postal Service. The secure, multi-page assembly 10 can include contents having value, e.g., a certain dollar value, such as movie or theater tickets, and/or can contain confidential information.

The assembly 10 includes at least a single ply or sheet 12 of paper, e.g., laser printer compatible paper or other paper suitable for printing, imaging, handwriting and/or otherwise disposing data on the assembly 10 for informational purposes, and suitable for folding either mechanically or by hand to form the assembly 10. The single sheet 12 can be a substantially planar sheet having a first or face surface 14 and an opposing second or back surface (not shown). The single sheet 12 is configured to define a first longitudinal (lengthwise) side edge 16 and a second longitudinal side edge 18 and a first transverse (widthwise) edge 22 and a second transverse edge 24, as shown in FIG. 1. The sheet 12 includes at least one central transverse fold line of perforations 26 defined through the first surface 14 and the second surface (not shown). The central transverse fold line of perforations 26 is disposed in the middle of the sheet 12, e.g., to define two substantially equal halves between the first and the second transverse edges 22 and 24 of the sheet 12. The central fold line of perforations 26 extends across at least a portion of a width $W_1$ of the sheet 12. The central fold line of perforations 26 is referred to hereinafter as the "cross fold perforations".

The sheet 12 further includes one or more longitudinal fold lines of perforations 28 defined parallel to the first and/or the second side edges 16 and 18 and which extend along at least a portion of a length $L_1$ of the sheet 12 to intersect with the cross fold perforations 26. The longitudinal fold lines of perforations 28 are referred to hereinafter as "fold assist perforations". The fold assist perforations 28 help to fold the sheet 12 into the desired or required folded configuration, as will be described below in further detail.

As referred to herein, lines of perforations that are described as cross fold, fold assist, or tear-off lines of perforations can include lines of perforations defined through the first or face surface 14 that extend either partially or entirely from the first or face surface 14 through the sheet 12 to the second or back surface (not shown) of the sheet 12. Whether a line of perforations extends partially or entirely from the first or face surface 14 through to the second or back surface (not shown) can depend on the function the line of perforations serves and the type of folded configuration the sheet 12 will be folded into. The invention is not limited in this respect and anticipates that different types of lines of perforations can be defined in the first or face surface 14 and/or the second or back surface to achieve a certain type of folded assembly 10.

The sheet 12 can define the cross fold perforations 26 and the one or more intersecting lines of fold assist perforations 28 such that the sheet 12 is segmented into six panels A, B, C, D, E and F, as shown in FIG. 1. Those of ordinary skill in the art will appreciate that the invention is not limited to the sheet 12 having two lines of fold assist perforations 28 and anticipates that the sheet 12 can include a single line of fold assist perforations 28 to define or segment the sheet 12 into four panels, or can include a greater number of lines of fold assist perforations 28 to produce more than six panels as shown. The number of panels the lines of fold assist perforations 28 define in the sheet 12 determines the number of pages that the multi-page assembly ultimately provides.

In addition, the sheet 12 includes a vertical stub portion 30, e.g., having a width $W_3$ of about 0.5 inches, disposed along each of the first and the second transverse edges 22 and 24. Each vertical stub portion 30 is defined by a transverse line of perforations 32 adjacent and parallel to one of the first and the second transverse edge 22 and 24 and which extends across at least a portion of a width $W_1$ of the sheet 12. The transverse lines of perforations 32 are referred to hereinafter as "vertical tear-off perforations". The sheet 12 further includes a horizontal stub portion 34 e.g., having a width $W_4$ of about 0.5 inches, disposed along each of the first and the second side edges 16 and 18. Each horizontal stub portion 34 is defined by a longitudinal line of perforations 36 parallel to one of the first and the second transverse edge 16 and 18 and which extends longitudinally along at least a portion of a $L_1$ of the sheet 12. As shown in FIG. 1, additional longitudinal lines of perforations 36 are disposed on either side of each fold assist line 32, adjacent and parallel to each fold assist line 32 and which extend longitudinally along at least a portion of a length $L_1$ of the sheet 12 to thereby define additional horizontal stub portions 34. The longitudinal lines of perforations 36 are referred to hereinafter as "horizontal tear-off perforations". The vertical and the horizontal tear-off perforations 32 and 36 permit a user to remove the vertical stub portions 30 and the horizontal stub portions 34, respectively, from the folded and sealed paper assembly 10 such that the user can open the assembly 10 in a book like manner as a multi-page booklet.

The sheet 12 further includes partial vertical lines of perforations 38 defined adjacent and parallel to the cross fold perforations 26 and extending between a pair of adjacent and parallel lines of horizontal tear-off perforations 36. Each partial vertical line of perforations 38 helps to define or segment the sheet 12 into the individual panels A, B, C, D, E and F, and permits the panel A, B, C, D, E and F with which it is associated to be torn along the perforations 38 to remove the panel from the assembly 10 when the assembly 10 is opened. The partial vertical lines of perforations 38 are referred to hereinafter as "partial vertical tear-off perforations".

As shown in FIGS. 1 and 2, the panels A, B, C, D, E and F are defined by the cross fold perforations 26, the fold assist perforations 28, the vertical tear-off perforations 32, the horizontal tear-off perforations 36 and/or the partial vertical tear-off perforations 38. The perforations 28, 32 and 36 can be defined in the sheet 12 at certain positions to provide a required number of panels A, B, C, D, E and F, and to configure each panel A, B, C, D, E and F with the required overall dimensions. In one embodiment of the invention, as shown in FIG. 2, the sheet 12 can have a length $L_1$ of about 17 inches and a width $W_1$ of about 11 inches with each panel A, B, C, D, E and F having a substantially similar length $L_2$. The widths $W_2$ of each panel A, B, C, D, E and F can vary. In one embodiment, preferred dimensions of the panels A, B, C, D, E and F can include the panel A having a width $W_2$ of 3 67/96 inches, the panel B having a width $W_2$ of 3 61/96 inches, and the panel C having a width $W_2$ of 3 2/3 inches. The panels D, E and F have widths $W_2$ including 3 2/3 inches, 3 61/96 inches and 3 67/96 inches, respectively. As shown in FIG. 2, the widths $W_2$ of the panels A, B and C disposed left of the cross fold perforations 26 inversely complement the widths $W_2$ of the panels D, E and F disposed right of the cross fold perforations 26 whereby the width $W_2$ of the panel A is similar to the width $W_2$ of the panel F and the width $W_2$ of the panel C is similar to the width $W_2$ of the panel D. The widths $W_2$ of the panels A, B, C, D, E and F can vary in some embodiments of the invention, e.g., embodiments according to the invention that provide a Z-fold type assembly 10, to provide for the thickness of the assembly 10 when the sheet 12 is folded along the cross fold and fold assist perforations 26 and 28. In another embodiment, the widths $W_2$ of the panels A, B, C, D, E and F are the same. As shown in FIG. 2, the sheet 12 can include a length $L_1$ of about 17 inches and a width $W_1$ of 11 inches such that the sheet 12 can be fed into and printed by a number of laser printers well known in the art. The invention is not limited in this respect and anticipates that the sheet 12 can define any range of overall dimensions, e.g., a length and a width, suitable for a particular purpose or application, and can define dimensions, e.g., a length and a width, of each of the panels as required or desired to distribute or otherwise provide certain data and information.

Figure 3:
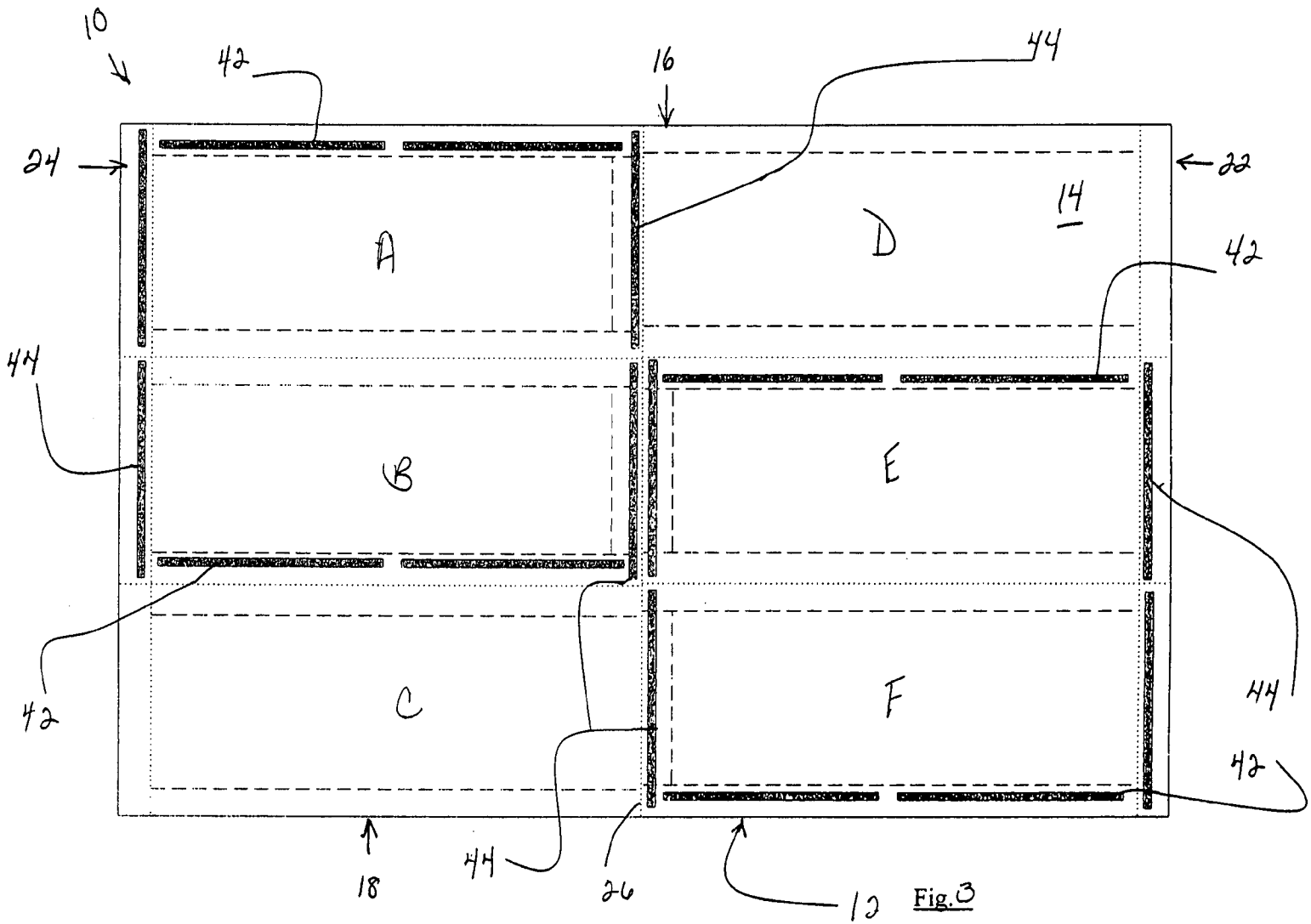
FIG. 3 is a perspective view of the first or face surface shown in FIG. 1 with deposits of pressure-activated cohesive disposed thereon.

The assembly 10 further includes a plurality of deposits of pressure-activated cohesive disposed at certain positions along at least one of the first or face surface 14 and the second or back surface (not shown) of the sheet 12. Referring to FIG. 3, and with further reference to FIG. 1, the first or face surface 14 includes a number of longitudinal lines of cohesive 42 disposed adjacent, and in some instances parallel to, one or both of the first and the second side edges 16 and 18 and which extend longitudinally along at least a portion of a length $L_1$ of the sheet. At least one line of cohesive 42 is disposed longitudinally along one or more horizontal stub portions 34. The face surface 14 further includes a number of transverse lines of cohesive 44 disposed across the sheet 12 adjacent, and in some instances parallel to, one or both of the first and the second transverse edges 22 and 24 and which extend across at least a portion of a width $W_1$ of the sheet 12. In one embodiment of the assembly 10 according to the invention, the panels A and B are outlined by a pair of parallel longitudinal lines 42 and a pair of parallel transverse lines 44, as shown in FIG. 3. Similarly, a pair of parallel longitudinal lines of cohesive 42 and a pair of parallel transverse lines of cohesive 44 outlines the panels E and F. The longitudinal and the transverse lines of cohesive 42 and 44 can be either continuous or discontinuous lines of cohesive, as shown in FIG. 3. The invention is not limited with respect to the type of cohesive used to form the assembly 10 and anticipates that a variety of cohesive can be used to bind and seal the sheet 12 when folded into the desired fold-type.

Figure 4:
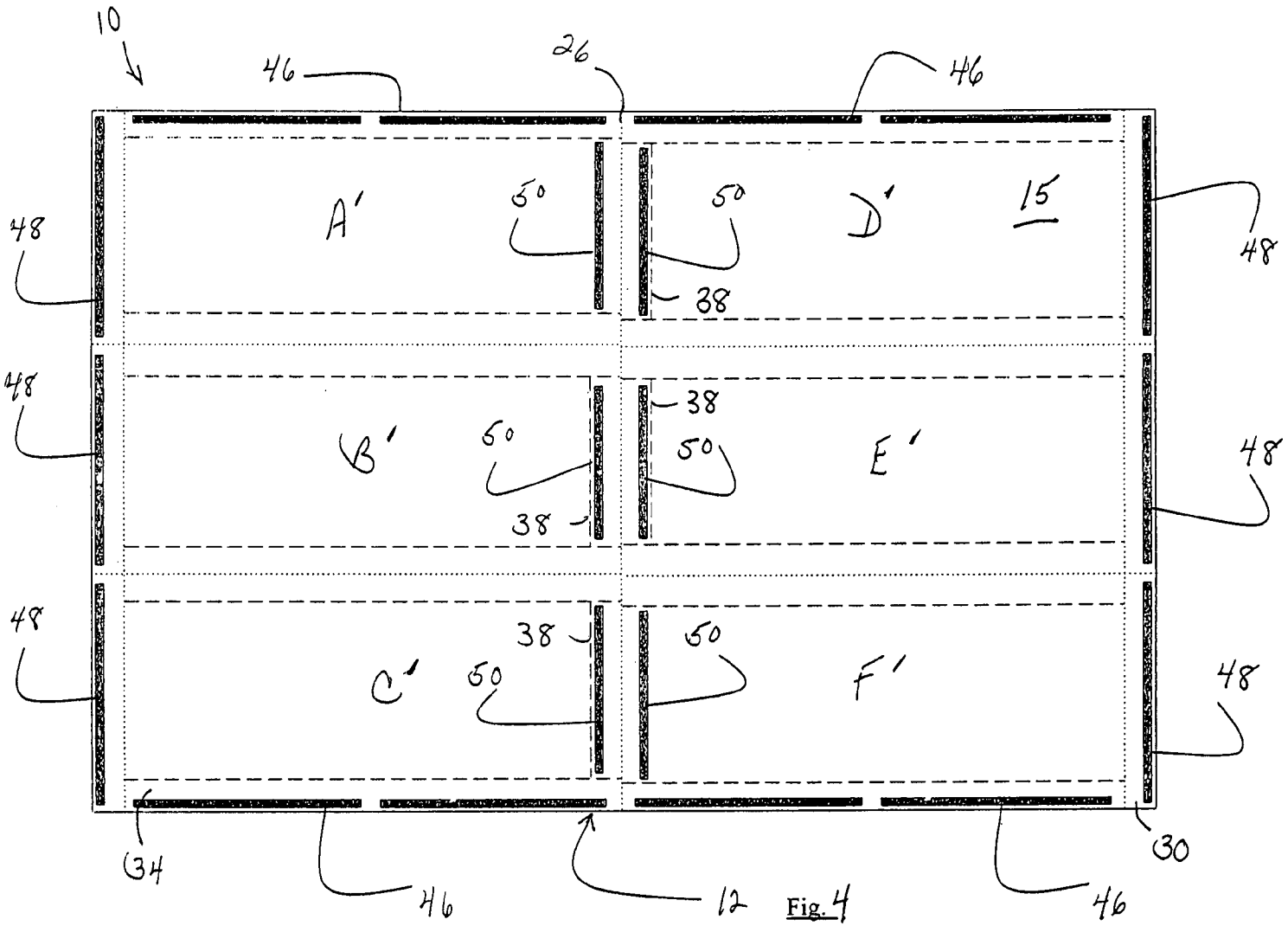
FIG. 4 is a perspective of a second or back surface of the single ply or sheet of paper shown in FIG. 1 with deposits of pressure-activated cohesive disposed thereon.

Referring to FIG. 4, a second or back surface 15 of the single paper sheet 12 is illustrated. The second or back surface 15 exposes the second or back side of the panels A', B', C', D', E' and F'. Longitudinal lines of pressure-activated cohesive 46 are disposed along each of the outermost horizontal stub portions 34 adjacent one or both of the first and the second side edges 16 and 18. Transverse lines of cohesive 48 are disposed along each of the vertical stub portions 30 adjacent one or both of the first and the second transverse edges 22 and 24. In addition, partial transverse lines of cohesive 50 are disposed between the cross fold perforations 26 and each of the partial vertical tear-off perforations 38.

With continued reference to FIGS. 3 and 4, placement of the longitudinal and transverse lines of cohesive 42, 44, 46, 48 and 50 along the face and the back surfaces 14 and 15 of the sheet 12 is determined at least in part by the number of panels defined by the sheet 12, the number of required pages of the multi-page assembly 10 and/or the type of folded configuration that the assembly 10 ultimately embodies. The type of folded configuration the assembly 10 can embody includes, for instance, a "Z-fold", "C-fold, eccentric C-fold," "V-fold" or "double parallel-fold" configuration, as such configurations are referred to in the art, which are accomplished according to known industry methods and standards. As described herein in further detail, forming the single sheet, multi-page assembly 10 according to the invention includes depositing cohesive 42, 44, 46, 48 and 50 along certain portions of the sheet 12 to adhere portions of the sheet 12 when folded and to outline the panels A, B, C, D, E, F and A', B', C', D', E', F' that will serve as inboard panels, e.g., those panels that will form the pages of the assembly 12, and folding the assembly 10 along the cross fold perforations 26 and certain fold assist perforations 28 to achieve a required type of folded configuration. As shown in FIGS. 3 and 4, the longitudinal and transverse lines of cohesive 42, 44, 46, 48 and 50 and the fold assist perforations 28 are disposed along the face and the back surfaces 14 and 15 to permit the sheet 12 to be folded into a Z-fold type assembly 10.

In addition, the type of data that is printed and/or imaged or otherwise disposed on the face surface panels A, B, C, D, E and F and on the back surface panels A', B', C', D', E' and F' and the orientation of such data, e.g., with respect to the first and the second side edges 16 and 18, can depend on the required type of folded configuration the assembly 10 ultimately achieves. The type of printed data and its orientation on each panel can be further determined by which panels are inboard panels or folded to the interior of the assembly 10 and which panels are outboard panel or folded to the exterior of the assembly 10.

Figure 5:
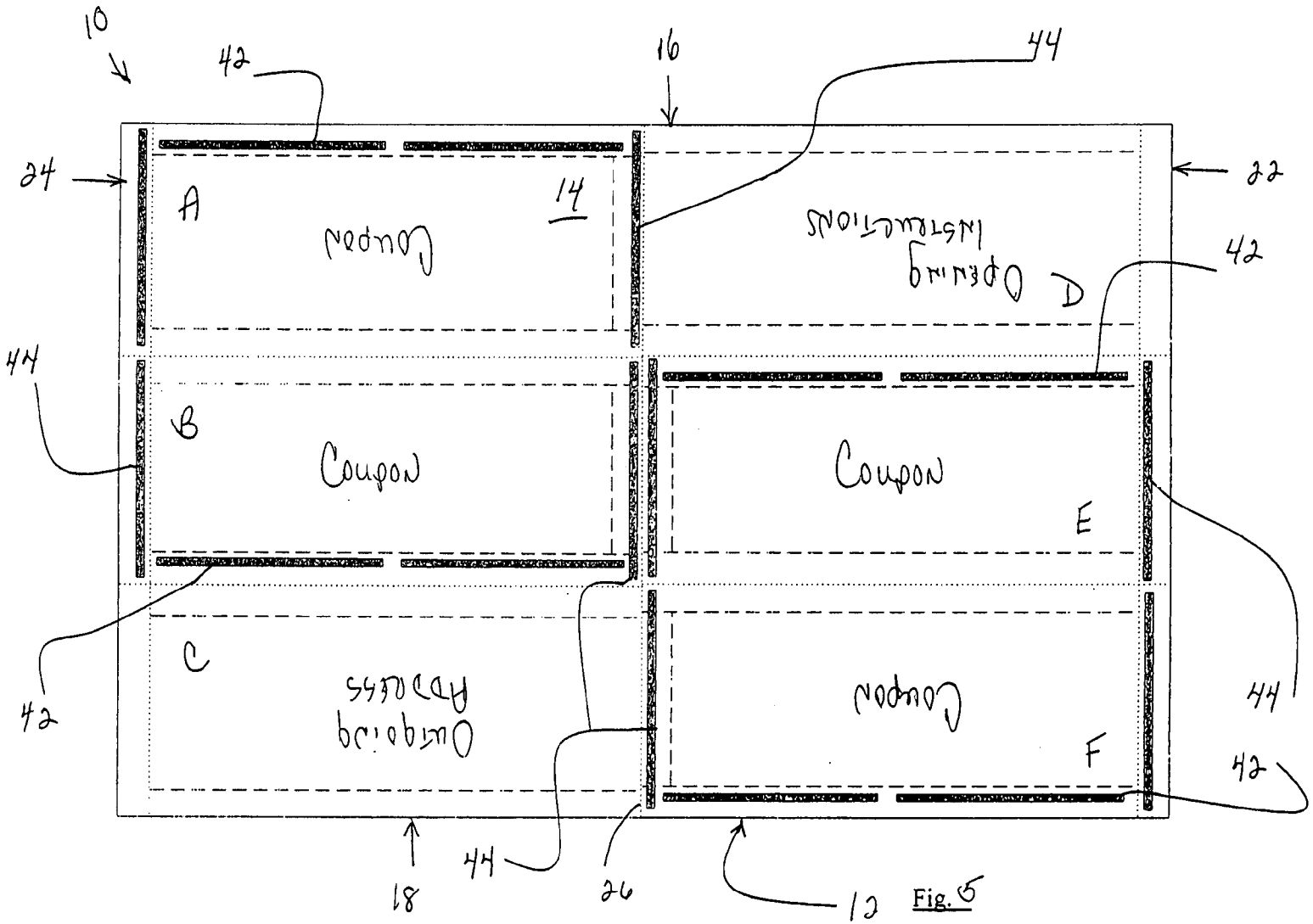
FIG. 5 is a perspective of the first or face surface of the ply or sheet of paper shown in FIG. 3 illustrating the orientation of printed data disposed along panels of the first or face surface to form a Z-fold assembly.
Figure 6:
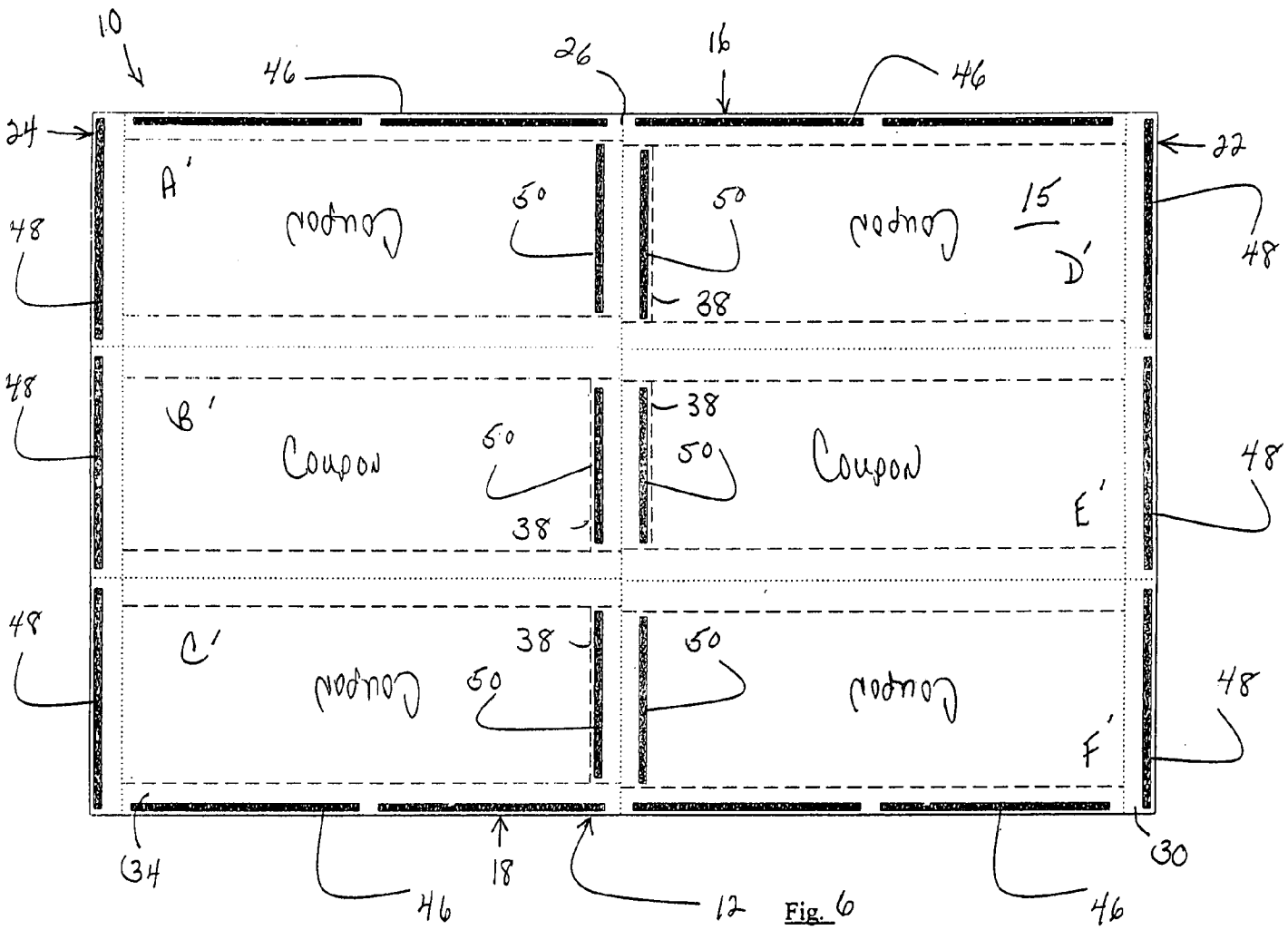
FIG. 6 is a perspective view of the second or back surface of the ply or sheet of paper shown in FIG. 5 illustrating the orientation of printed data disposed along panels of the second or back surface to form a Z-fold assembly.

The printed data disposed on the panels A, B, C, D, E and F can be oriented to achieve a certain type of folded configuration including a Z-fold, C-fold, eccentric C-fold, V-fold or double parallel-fold. Referring to FIGS. 5 and 6, in one embodiment of the invention, the assembly is configured as a Z-fold type of assembly 10 and can include, for instance, the panels C and D serving as outboard panels along the exterior of the assembly 10 whereby the panel C can provide an outgoing address and the panel D can provide instructions to open the assembly 10. Other panels A, B, E and F can serve as inboard panels disposed within the interior of the assembly 10 to form the multiple pages and can include printed data and information as required or desired, e.g., redeemable coupon information. The type and the orientation of the printed data on each panel A', B,' C', D', E' and F' of the back surface 15, as noted, is similarly determined by the type of folded configuration the assembly 10 embodies.

Referring to FIGS. 7A-7D, and with continued reference to FIGS. 3 and 4, the sheet 12 is folded into a Z-fold type of configuration. Folding the assembly 10 can be achieved by a variety of methods and/or mechanisms including folding the assembly 10 by hand or by a folder/sealer machine, such as, for instance, the PS 600X folder/sealer available from Paragon of England to fold and to seal the sheet 12. In other embodiments, a stand-alone sealing unit can seal the folded sheet 12, such as, for instance, the PS-50 available from Paragon of England, and the PS-4 Turbo from Moore Business Forms of Grand Island, N.Y.

Figure 7A:
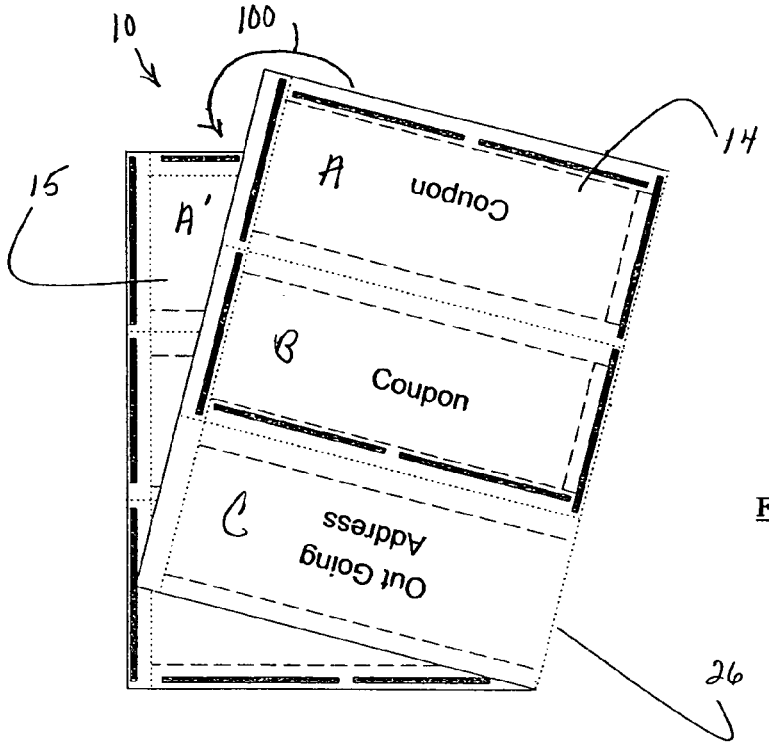
FIGS. 7A-7D are perspective views of the single ply or sheet of paper shown in FIGS. 5 and 6 folded into a Z-fold assembly.

The sheet 12 is folded in half along the cross fold perforations 26, as shown by arrow 100 in FIG. 7A, such that the longitudinal lines of cohesive 46 disposed along the back surface 15 on the right side of the cross fold perforation 26 align with the longitudinal lines of cohesive 46 disposed on the left side of the cross fold perforations 26. Similarly, the transverse lines of cohesive 48 and the partial vertical lines of cohesive 50 disposed along the right side of the cross fold perforations 26 align with the lines of cohesive 48 and 50 disposed along the left side when the sheet 12 is folded along the cross fold perforations 26. The back surface 15 of the sheet 12 is thereby folded in half and the face surface 14 is disposed as an exterior surface of the assembly 10.

Figure 7B:
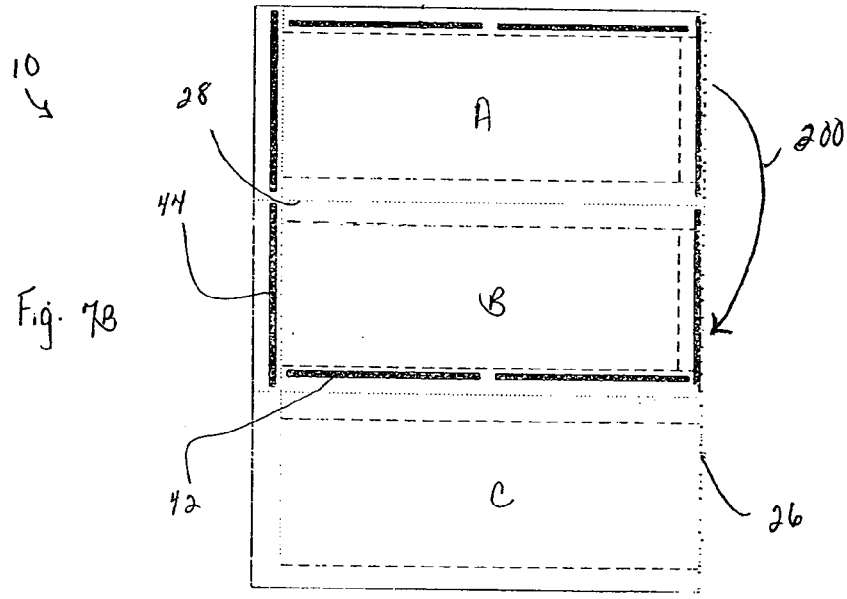
Figure 7C:
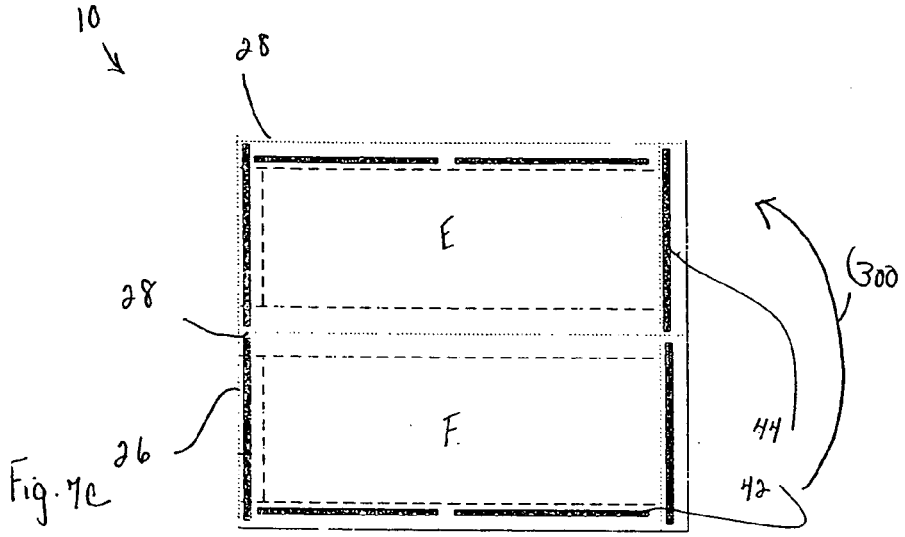

The sheet 12 is then folded along the fold assist perforations 28 between the panels A and B, as shown by the arrow 200 in FIG. 7B, whereby the transverse lines of cohesive 42 align and the longitudinal lines of cohesive 44 align when the panel A is folded to the panel B. As shown in FIG. 7C, which illustrates the side of the folded sheet 12 opposite to the panels A and B, the sheet 12 is further folded along the fold assist perforations 28 between the panels E and F, as shown by the arrow 300. The lines of cohesive 42 and 44 align when the panel F is folded to the panel E.

Figure 7D:
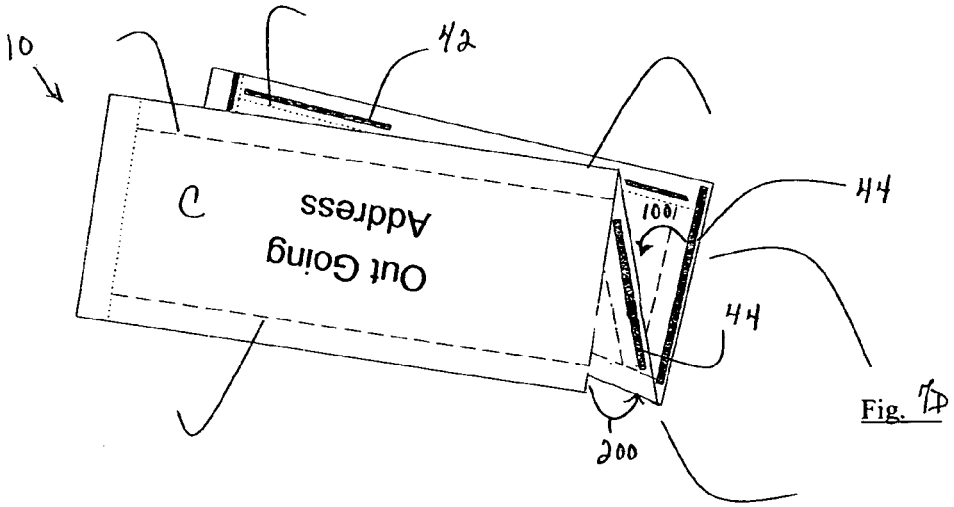

As shown in FIG. 7D, folding the sheet 12 as described and as shown by the arrows 100, 200 and 300 in FIGS. 7A-7C, Z-folds the sheet 12 to form the assembly 10. Once the assembly 10 is folded, the assembly 10 is further processed to seal the assembly 10. The folded assembly 10 is pressure sealed according to any method well known in the art whereby pressure is applied to the folded assembly 10 to activate the deposits of pressure-activated cohesive and to bind or adhere the folded portions of the assembly 10 to thereby form the sealed assembly 10.

Figure 8:
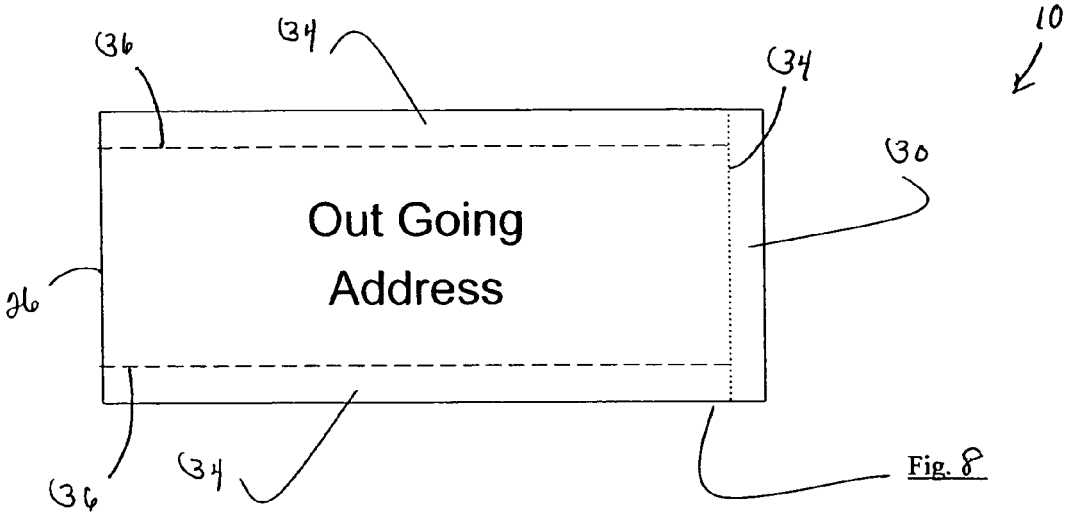
FIG. 8 is a perspective view of the sealed multi-page Z-fold paper assembly formed from stages shown in FIGS. 7A-7D.
Figure 9:
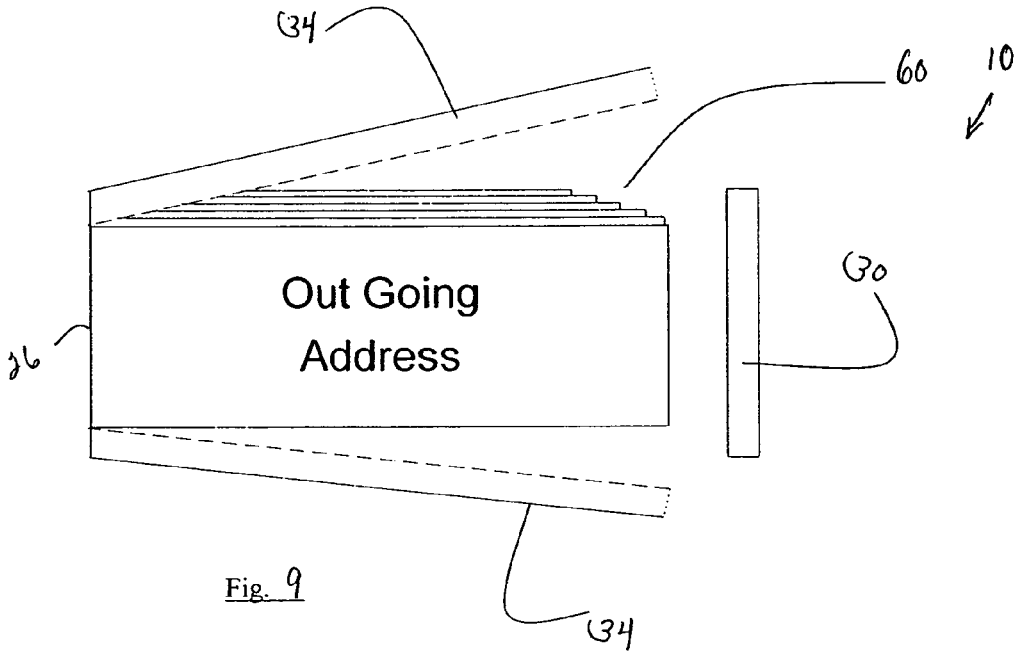
FIG. 9 is a perspective view of the multi-page Z-fold paper assembly shown in FIG. 8 opened to access multiple pages contained in the assembly.

Referring to FIGS. 8 and 9, the assembly 10 serves as a sealed multi-page assembly or booklet suitable for further processing, distributing and/or mailing. As shown in FIGS. 8 and 9, and as described above, the assembly 10 can be a Z-fold assembly. To open the assembly 10, a user tears off the removable vertical stub portion 30 along the transverse line of perforations 32 and tears off the removable horizontal stub portions 34 along the longitudinal lines of perforations 36 to remove certain adhered longitudinal and transverse lines of cohesive 42 and 44 to open the assembly 10 along three sides. The cross fold perforations 26 and associated transverse lines of cohesive 44 and 50 disposed along the face and the back surfaces 14 and 15 of the sheet 12 form a binder, which is not removable and permits the assembly 10 when opened along its three sides in a book like manner. The panels A, B, E and F and A', B', C', D' E' and F', collectively shown in FIG. 9 as numeral 60, comprise removable pages of the assembly 10. In one embodiment, the assembly 10 can include a coupon booklet wherein the panels 60 can include, for instance, coupons, gift certificates, movie/theater tickets and/or other redeemable items that can be removed from the assembly 10 as desired.

Figure 10:
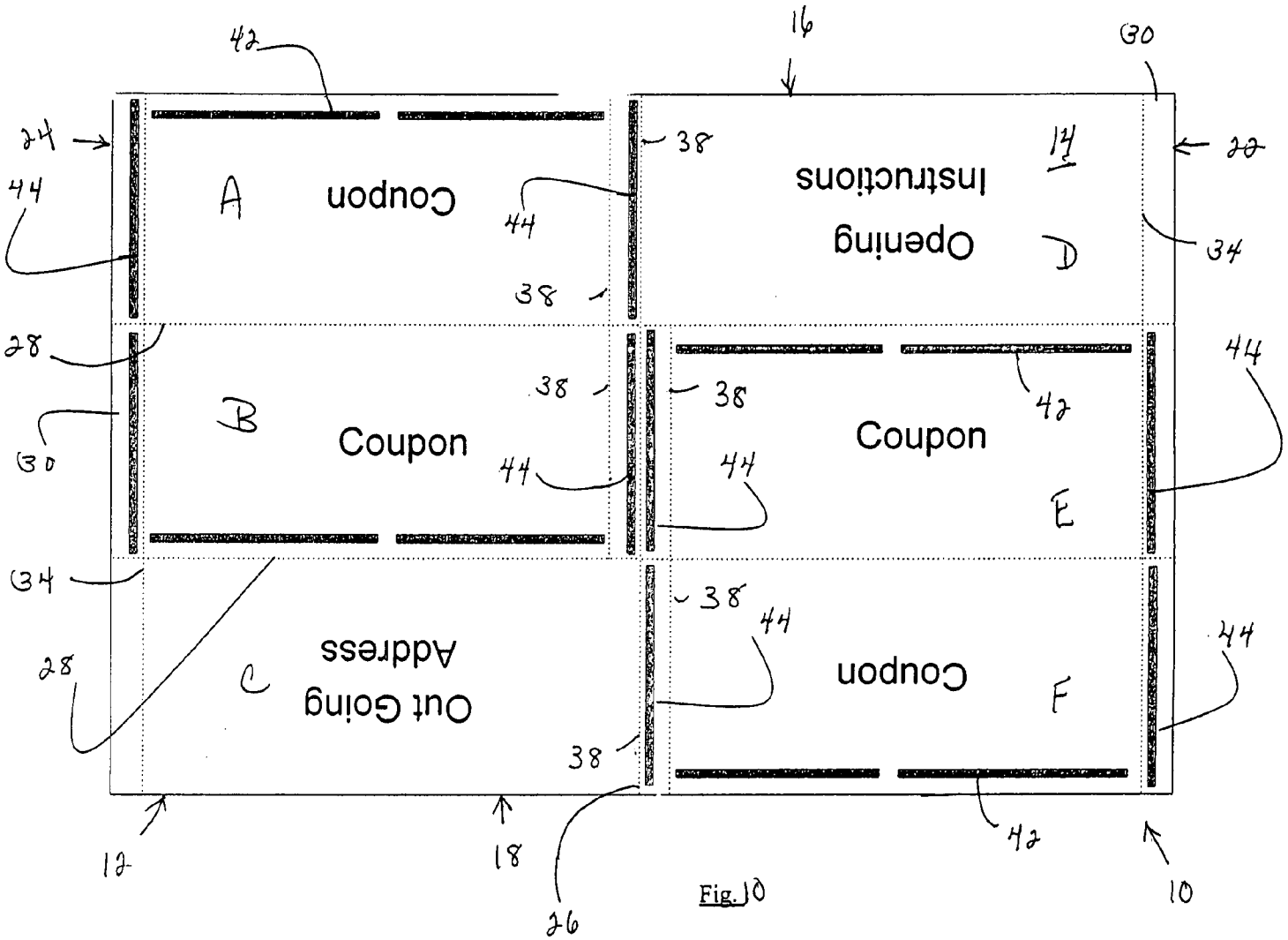
FIG. 10 is a perspective view of a first or face surface of a single ply or sheet of paper with deposits of pressure-activated cohesive disposed thereon used to form a second embodiment of a sealed multi-page paper assembly according to the invention.
Figure 11:
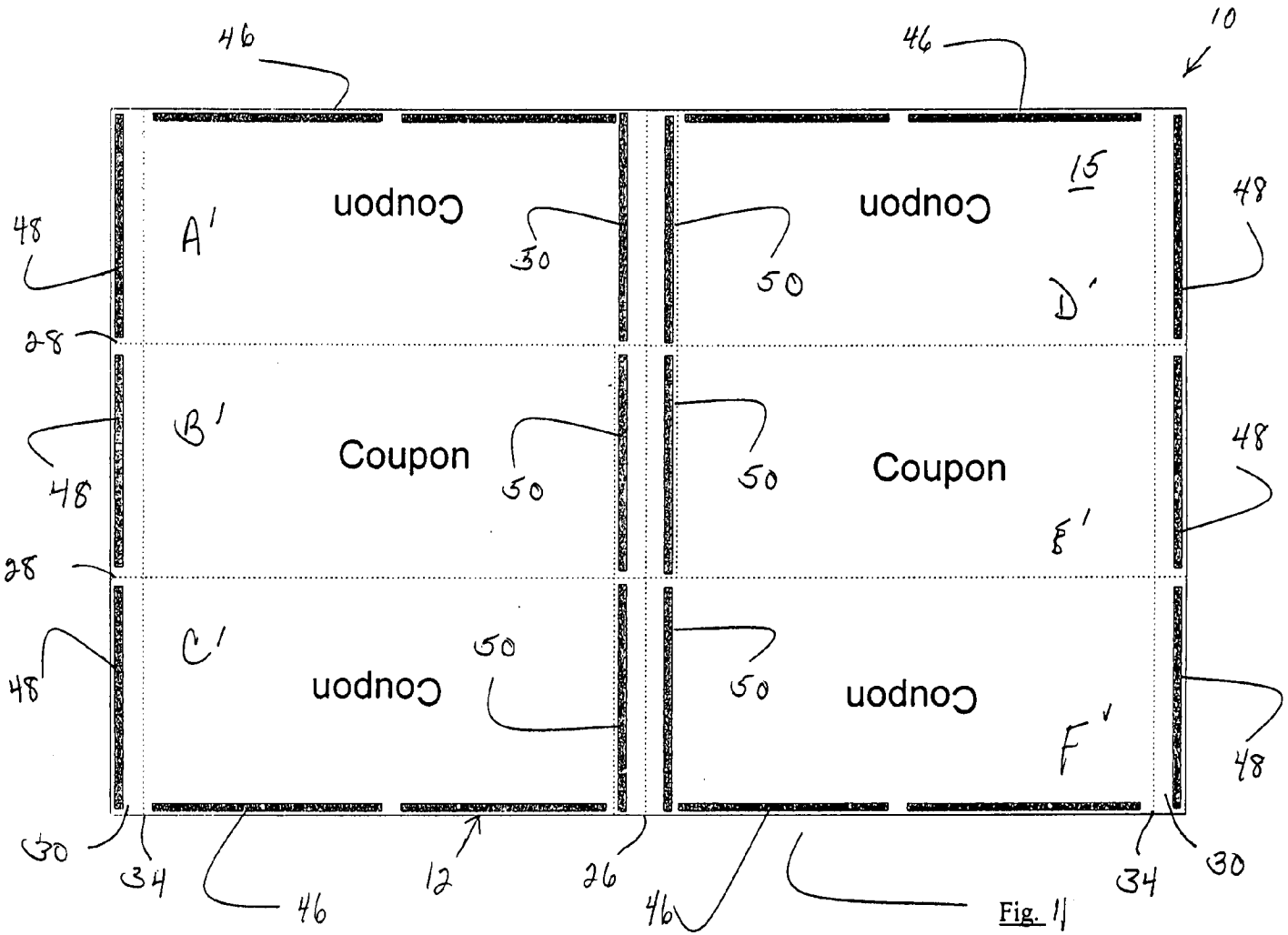
FIG. 11 is a perspective view of a second or back surface of the single ply or sheet of paper shown in FIG. 9 with deposits of pressure-activated cohesive disposed thereon.

Referring to FIGS. 10 and 11, in another embodiment of the assembly 10 according to the invention, the assembly 10 includes an unsecured multi-page assembly 10. As used herein to disclose the invention, the term "unsecured" refers to the ease with which the sealed multi-page assembly 10 can be opened and with which the inboard panels that compose the multiple pages of the assembly 10 can be separated from one another and removed from the assembly 10. The unsecured assembly 10 includes certain deposits of "low-tack", e.g., less binding, cohesive that does not form an aggressive seal when the assembly 10 is processed, e.g., during or after folding, by any of the pressure-sealing methods well known in the art. The "low-tack" cohesive permits the assembly 10 to be easily opened and the inboard panels A, B, E and F and A', B', C', D' E' and F' to be easily separated from each other. As described below in further detail, the unsecured multi-page assembly 10 can be opened by tearing off a vertical stub portion and peeling apart one of the outboard panels C and D from the inboard panels A, B, E and F and A', B', C', D' E' and F'. Each inboard panel can be then peeled from adjacent panels by peeling the individual panel along lines of cohesive to separate the panel from the remaining panels. Once separated, the individual inboard panel can be removed from the assembly 10 by tearing the panel along a line of tear-off perforations. The unsecured multi-page paper assembly 10 can serve as an unsecured document or business form including, for instance, a direct mail piece such as an advertising brochure or a free coupon booklet.

As shown in FIG. 10, the sheet 12 includes along its first or face surface 14 the line of cross fold perforations 26 disposed centrally to divide the sheet 12 about in the middle, e.g., to define substantially equal halves between the first and the second transverse edges 22 and 24 of the sheet 12. The sheet further includes one or more longitudinal fold lines of perforations 28 defined parallel to the first and/or the second side edge 16 and 18 and extending along at least a portion of a length $L_1$ of the sheet 12 to intersect with the cross fold perforations 26 and to thereby define or segment the sheet into four or more panels. As shown in FIG. 10, the sheet 12 includes two longitudinal lines of fold assist perforations 26 to define six panels A, B, C, D, E and F. The invention, as noted above, is not limited by the number of lines of fold assist perforations 28 and anticipates that the sheet 12 can include one or more lines of fold assist perforations 28 to segment the sheet 12 into a multi-panel assembly 10.

The sheet 12 further includes a vertical stub portion along each of the first and the second transverse edges 22 and 24, e.g., having a width $W_3$ of about 0.5 inches, and defined by a line of tear-off perforations 34. Additional lines of tear-off perforations 38 are disposed on either side of the cross fold perforations 26, parallel to the cross fold perforations 26 and/or the first and the second transverse edges 22 and 24. Each additional line of tear-off perforations 38 permits the panel A, B, E and F with which it is associated to be torn along the line of tear-off perforations 38 to remove the panel from the assembly 10 when formed.

In addition, the sheet 12 includes a number of deposits of pressure-activated cohesive 42 disposed parallel to one or both of the first and the second side edges 16 and 18 and which extend longitudinally along at least a portion of a length $L_1$ of the sheet 12. In one embodiment, the longitudinal deposits of cohesive 42 include low tack, pressure-sensitive adhesive. A number of deposits of pressure-activated cohesive 44 are also disposed parallel to one or both of the first and the second transverse edges 22 and 24 and which extend across at least a portion of a width $W_1$ of the sheet 12. The deposits of cohesive 42 and 44 can include either continuous and/or noncontinuous lines of cohesive, as shown in FIG. 10. As described above with reference to FIG. 3, placement of the lines of cohesive 42 and 44 is determined by the number of panels defined in the sheet 12 and/or the type of folded configuration, e.g., a Z-fold, C-fold, eccentric C-fold, V-fold or double parallel-fold, the assembly 10 assumes. The type of folded configuration determines those panels A, B, C, D, E and F along the fact surface 14 that will serve as inboard panels or outboard panels when the sheet 12 is folded accordingly into the assembly 10. As shown in FIG. 10, the longitudinal and transverse lines of cohesive 42 and 44 outline the panels A and B and the panels E and F such that the sheet 12 can be folded into a Z-fold assembly 10, as described above.

Referring to FIG. 11, the second or back surface 15 of the sheet 12 includes the cross fold perforations 26 and one or more lines of the fold assist perforations 28 defined through the first or face surface 14 of the sheet 12 and extending longitudinally along a length $L_1$ of the sheet 12 to intersect the cross fold perforations 26. The second or back surface 15 of the sheet 12 is similarly segmented by intersection of the cross fold perforations 26 and the fold assist perforations 28 into six panels A', B', C', D', E' and F' that serve as the back side of the panels A, B, C, D, E and F disposed at the face surface 14 of the sheet 12. The back surface 15 further includes one or more deposits of pressure-activated cohesive 46 disposed adjacent and parallel to one of the first and the second side edges 16 and 18 and which extend longitudinally along at least part of a length $L_1$ of the sheet 12. In one embodiment, the longitudinal deposits of cohesive 46 include low-tack, pressure-activated cohesive.

In addition, the back surface 15 can include one or more deposits of pressure-activated cohesive 48 disposed adjacent and parallel to one of the first and the second transverse edges 22 and 24 and within the vertical stub portions 30 defined by the lines of tear-off perforations 34. The transverse deposits of cohesive 48 extend across at least part of a width $W_1$ of the sheet 12. Additional transverse deposits of pressure-activated cohesive 50 are disposed on either side of the cross fold perforations 26 and parallel to the first and the second transverse edge 22 and 24. The transverse deposits of cohesive 50 and the cross fold perforations 26 fold and seal the sheet 12 in such a manner that the cohesive 50 and the cross fold perforations 26 serve as a binder of the assembly 10. As described above with reference to FIG. 10, the deposits of adhesive 46, 48 and 50 can include continuous or discontinuous lines of cohesive.

Figure 12:
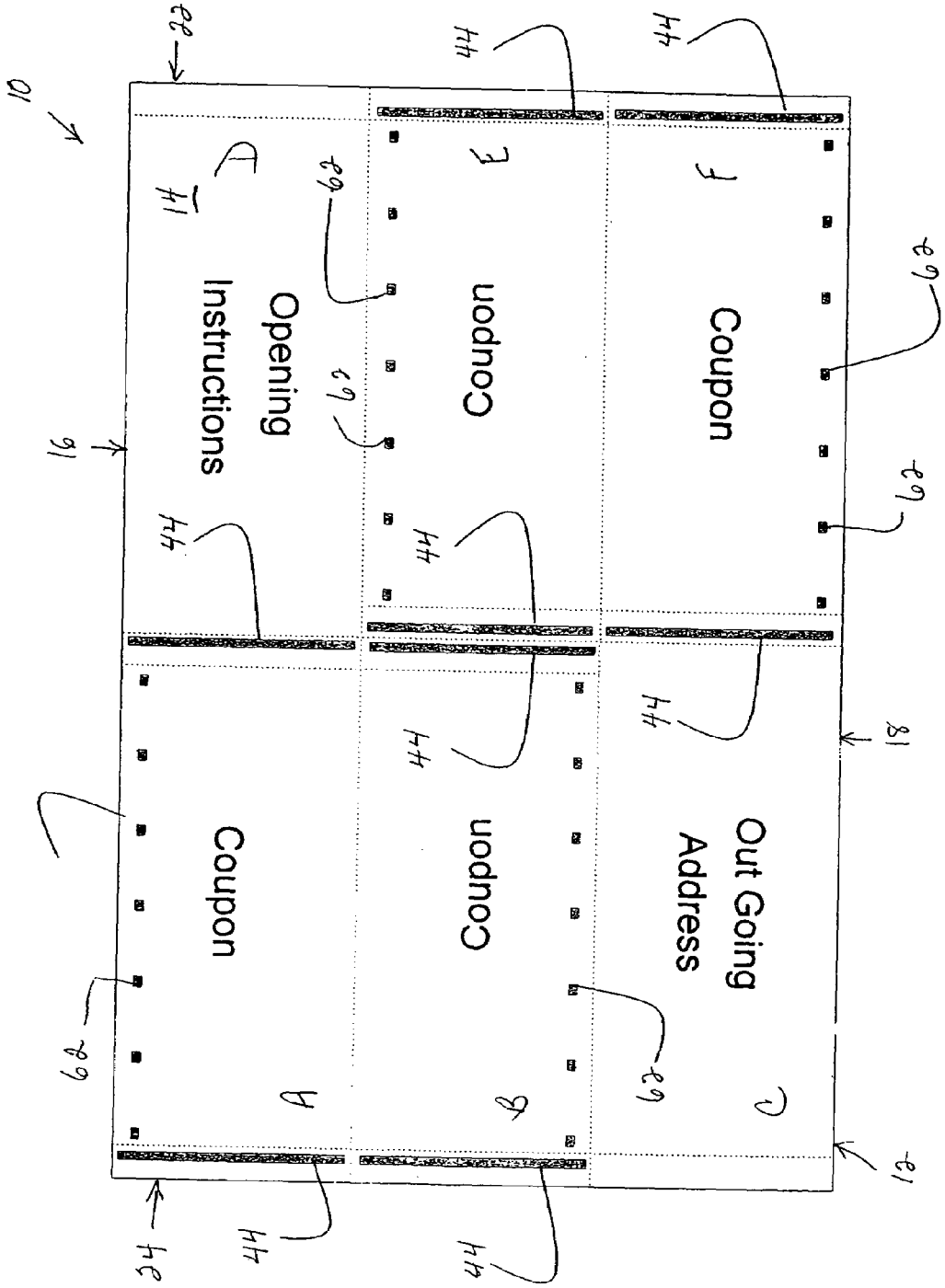
FIG. 12 is a perspective view the first or face surface of the single ply or sheet of paper shown in FIG. 10 with longitudinal segments of cohesive disposed thereon.
Figure 13:
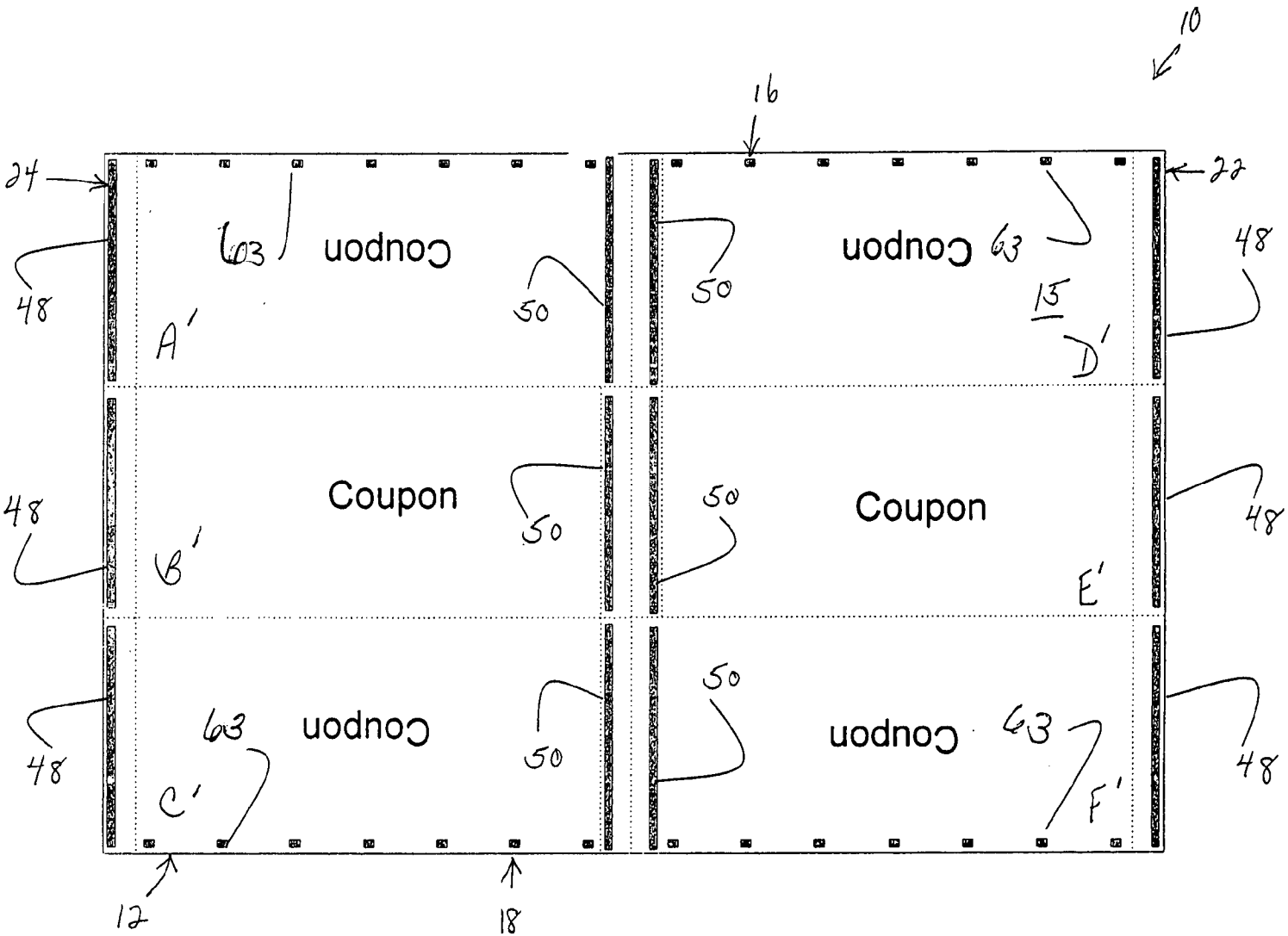
FIG. 13 is a perspective view of the second or back surface of the single ply or sheet of paper shown in FIG. 12 with outermost longitudinal segments of cohesive disposed thereon.

Referring to FIGS. 12 and 13, and with further reference to FIGS. 10 and 11, in one embodiment of the invention, the outermost longitudinal deposits of cohesive 42 disposed on the face surface 14 adjacent each of the first and the second side edges 16 and 18, and the outermost longitudinal deposits of cohesive 46 disposed along the back surface 15 adjacent each of the first and the second side edges 16 and 18 include a plurality of spots, dots and/or segments of pressure-activated cohesive 62 and 63. The plurality of longitudinal spots, dots and/or segments of low tack cohesive 62 and 63 permit a relatively less aggressive seal to be achieved when the sheet 12 is folded and ultimately sealed to form the assembly 10. In one embodiment, some or all of the deposits of cohesive 42, 44, 46, 48, 62 and 63, as shown in FIGS. 10-13, can include a low-tack, pressure-activated cohesive to provide a less aggressive seal and to permit the assembly 10 and the multiple of pages to be opened by pulling or peeling apart certain panels or pages of the assembly 10. Any of a variety of low-tack cohesive may be used such as, for instance, U-Seal available from Ward Kraft of Ft. Scott, Kans., and Moore Topan Cohesive available from Moore Business Forms of Grand Island, N.Y. The invention is not limited in this respect and anticipates any low-tack cohesive known in the art suitable for use with the paper assembly 10, as described herein, and suitable for binding or adhering folded portions of the sheet 12 by pressure-sealing methods know in the art can be used. As described above, the low tack cohesive helps to permit easy removal of one or both of the outboard panels C and D along the first and the second side edges 16 and 18 to open the assembly 10 in a book like manner, eliminating the need for tearing the assembly 10, e.g., along horizontal tear stub portions.

Figure 14:
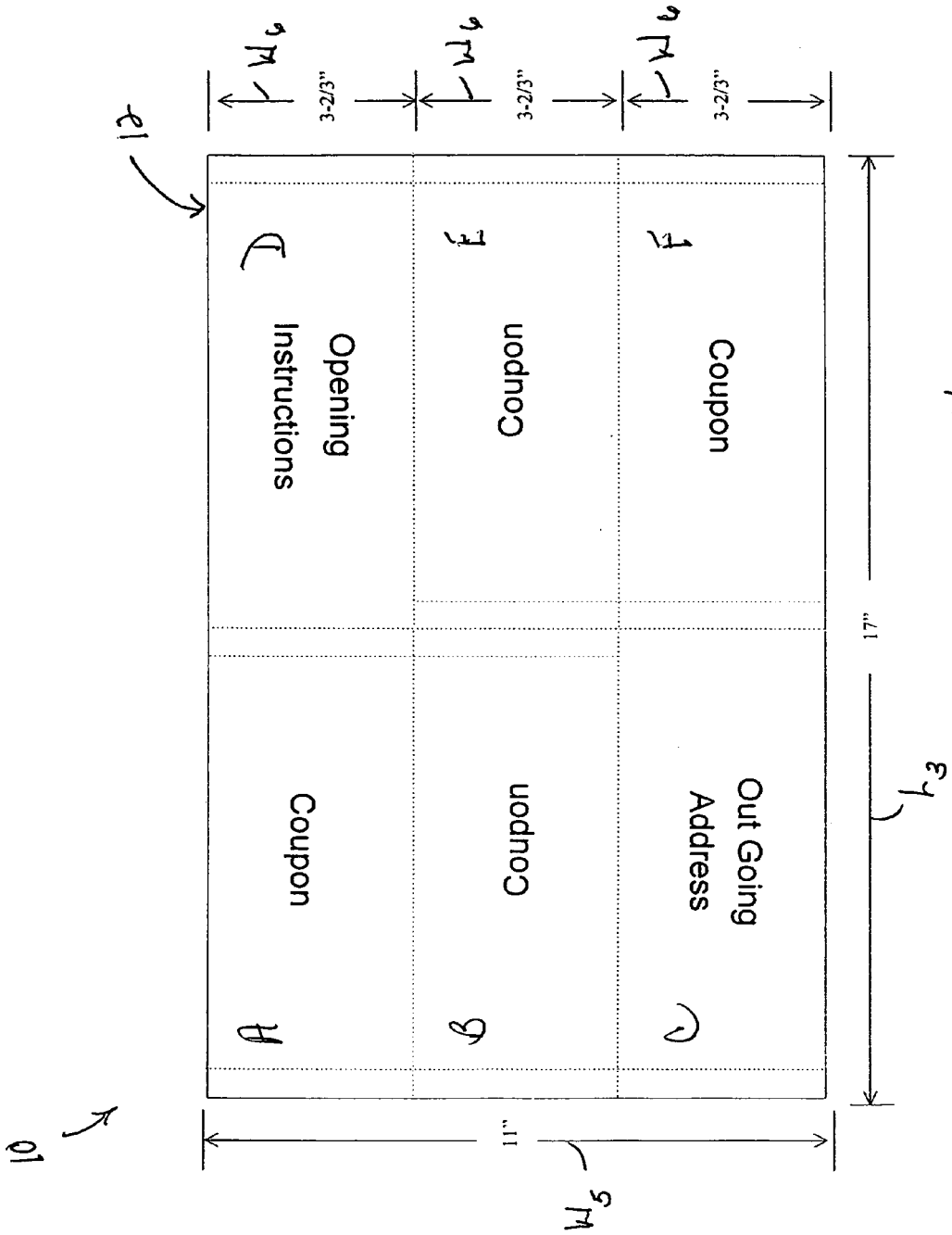
FIG. 14 is a perspective view of the single ply or sheet of paper shown in FIG. 10 illustrating dimensions.

Referring to FIG. 14, the sheet 12 can include the panels A, B, C, D, E, and F each having a similar length and a similar width. The panels A', B', C', D', E', and F' along the back surface 15 (not shown) have similar dimensions to the panels the panels A, B, C, D, E, and F of the face surface 15. In one embodiment, the sheet 12 has a length $L_3$ of about 11 inches and a width $W_5$ of about 17 inches and each of the panels has a similar width $W_6$ of about 3⅔ inches. The invention anticipates other embodiments of the invention can include the sheet 12 having a length $L_3$ and a width $W_5$ of a range of dimensions.

Referring to FIG. 15, the unsecured, multi-page paper assembly 10 is folded in any of a variety of configurations well known in the art and can include a "Z-fold", a "C-fold, eccentric C-fold," a "V-fold" and a "double parallel-fold", as described above and with reference to FIGS. 1-6. As shown in FIGS. 11-13, the placement of the lines of cohesive 42, 44, 46, 48 and 50 and the spots, dots and/or segments of cohesive 62 and 63 is determined by the number of panels of the assembly 10 and the folded configuration that the assembly 10 ultimately embodies once it is folded and sealed according to the invention. The assembly 10 shown in FIGS. 11-13 includes the lines of cohesive 42, 44, 46, 48 and 50 and the spots, dots and/or segments of cohesive 62 and 63 disposed to enable the sheet 12 to be Z-folded according to at least those stages described with reference to and as illustrated in FIGS. 7A-7D. As a result of Z-folding, the assembly 10 can be further processed and/or distributed.

As shown in FIG. 15, the assembly 10 can be opened by removal of the vertical stub portion 30 by tearing the portion 30 along the lines of tear-off perforations 34. Each of the outboard panels C and D and the inboard panels A, B, E and F and A', B', C', D', E' and F', collectively referred to as numeral 70 in FIG. 15, can be easily peeled from adjacent panels along the deposits of low tack cohesive 62 and 63 disposed along the face and the back surfaces 14 and 15 of the sheet 12. Peeling the panels from adjacent panels thereby opens the assembly 10 and permits each panel to be separated such that the multiple panels 70 of the assembly 10 can serve as pages of a booklet. The transverse lines of cohesive 44 and 50 and the cross fold perforations 26 serve to form a binder when the assembly 10 is folded and sealed that permits the assembly 10 to open in a book like manner. The inboard panels, as noted above, serve as removable pages.

Figure 16:
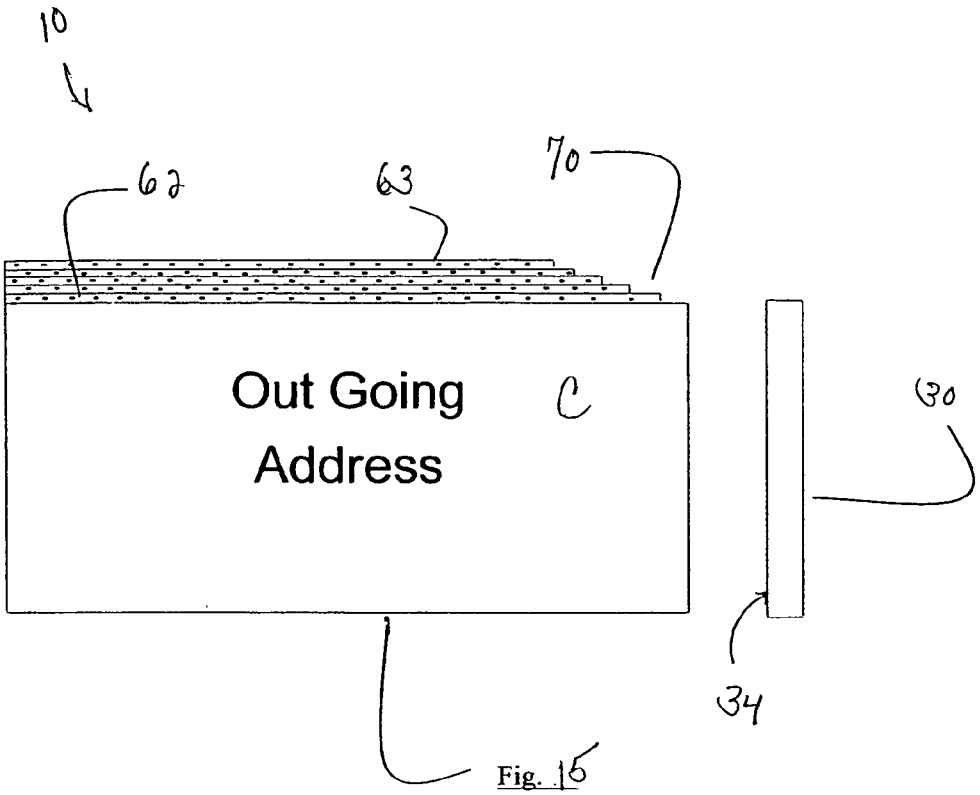
FIGS. 16-16A provide a block flow diagram illustrating a process of forming a sealed multi-page paper assembly according to one embodiment of the invention.
Figure 16:
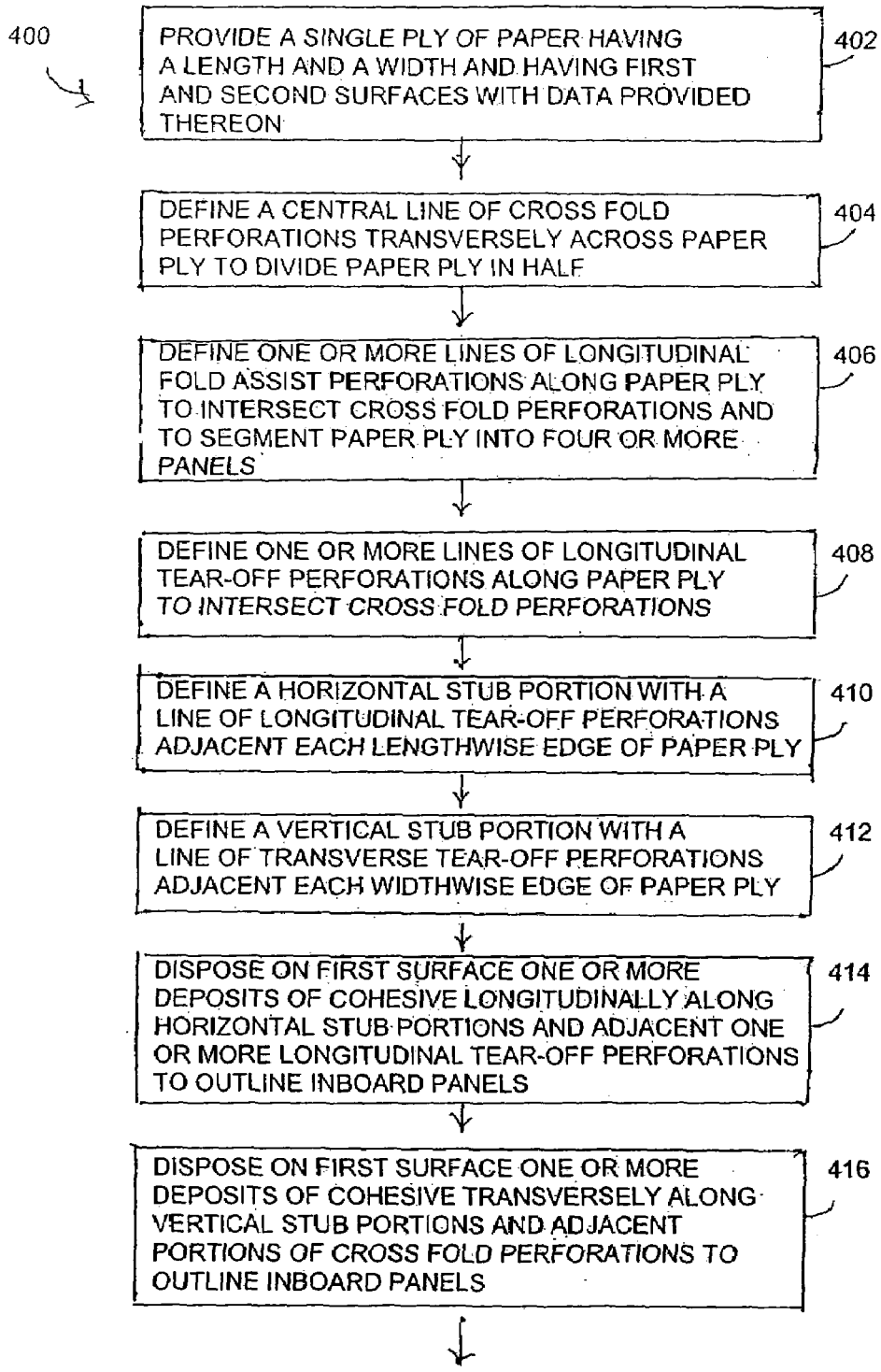
Figure 16A:
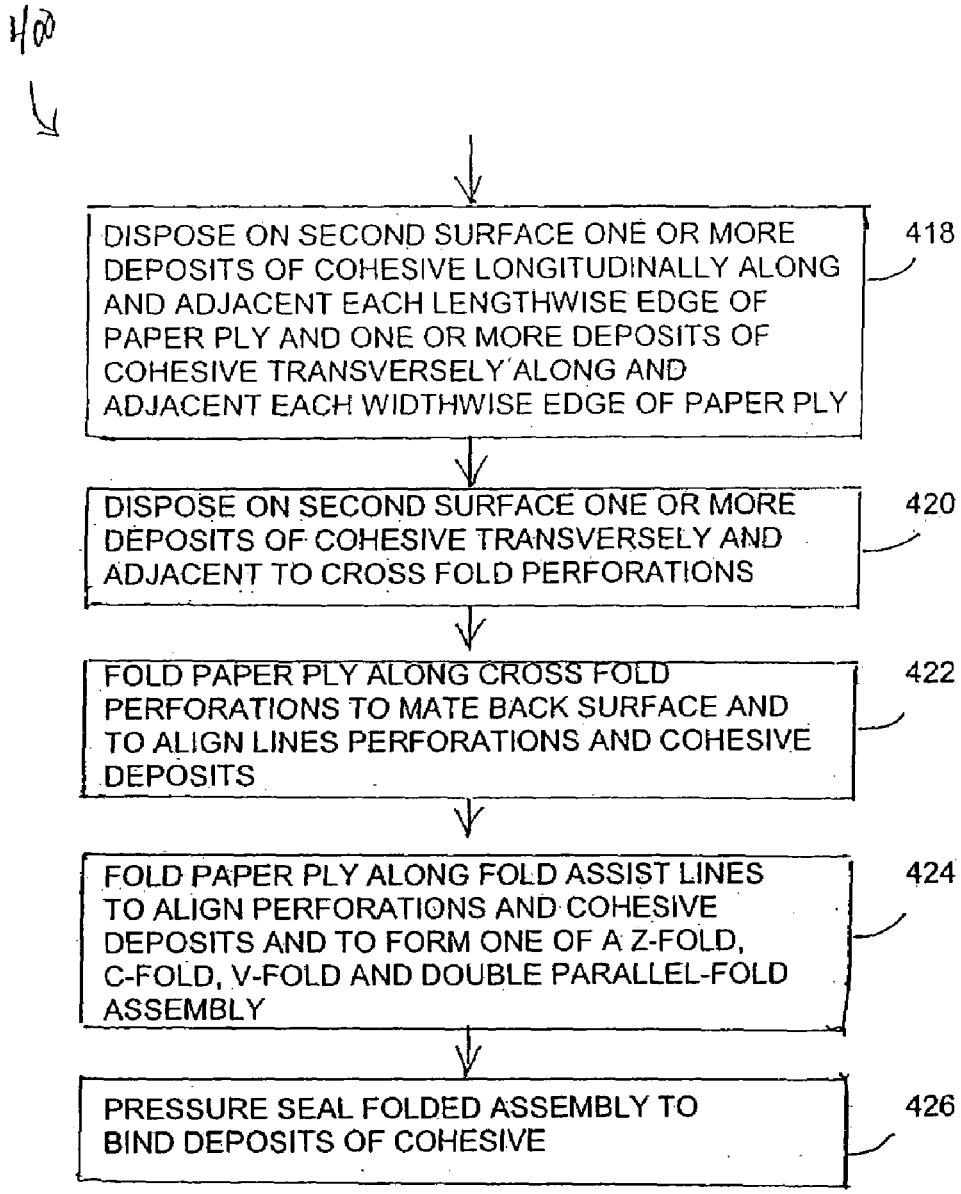

Referring to FIGS. 16-16A, another aspect of the invention provides a process 400 for constructing a sealed, multi-page paper assembly by folding and sealing a single ply or sheet of paper. The process 400, however, is exemplary only and not limiting. The process 400 can be altered, e.g., by having stages added, removed or rearranged.

At stage 402, the single ply or sheet of paper 12 is provided having the face surface 14 and the back surface 15 and defining a length $L_1$ and a width $W_1$, wherein the face and the back surfaces 14 and 15 have printed, imaged, handwritten and/or otherwise disposed thereon data and information to be provided to an end user.

At stage 404, the central transverse line of cross fold perforations 26 is defined in the face surface 14 and extends partially or entirely through the sheet 12 to the back surface 15 such that the cross fold perforations 26 on each surface 14 and 15 are aligned and opposite to each other, and parallel to each of the first and the second transverse edges 22 and 24. The transverse line of cross fold perforations 26 is defined in about the middle of the sheet 12, e.g., to separate the sheet 12 into two halves including a left side and a right side. In one embodiment, each half has equal dimensions to the other half.

At stage 406, one or more longitudinal lines of fold assist perforations 28 are defined in the face surface 14 and extend partially or entirely through the sheet 12 to the back surface 15 such that the lines of fold assist perforations 28 intersect the cross fold perforations 26 and segment the face surface 14 and the back surface 15 into four or more panels.

At stage 408, one or more longitudinal lines of tear-off perforations 36 are defined in the face surface 14 and extend partially or entirely through the sheet 12 to the back surface 15. At least one longitudinal line of tear-off perforations 36 is disposed parallel to each of the first and the second side edges 16 and 18 such that the horizontal tear-off perforation 36 intersects the cross fold perforations 26. Additional longitudinal lines of tear-off perforations 36 can be defined on each side of the longitudinal lines of fold assist perforations 28 parallel to each of the first and the second side edges 16 and 18 to intersect the cross fold perforations 26.

At stage 410, horizontal stub portions 34, e.g., having a width $W_4$ of about 0.5 inches, are defined in the face surface 14 along each of the first and the second side edges 16 and 18 by a longitudinal line of tear-off perforations 36 defined adjacent and parallel to the first and the second side edges 16 and 18 and extending partially or entirely through the sheet 12 to the back surface 15.

At stage 412, vertical stub portions 30, e.g., having a width $W_3$ of about 0.5 inches, are defined in the face surface 14 along each of the first and the second transverse edges 22 and 24 by a transverse line of tear-off perforations 32 defined adjacent and parallel to the first and the second transverse edges 22 and 24 and extending partially or entirely through the sheet 12 to the back surface 15.

At stage 414, one or more deposits of cohesive 42 are disposed longitudinally on the face surface 14 adjacent one or more horizontal tear-off perforations 36 and along at least a portion of a length $L_1$ of the sheet 12. The longitudinal deposits of cohesive 42 outline one or more panels of the face surface 14 that will serve as inboard panels or pages of the multi-page assembly 10.

At stage 416, one or more deposits of cohesive 44 are disposed transversely on the face surface 14 adjacent the vertical tear-off perforations 32 and adjacent and parallel to the cross fold perforations 26. The transverse deposits of cohesive 44 outline one or more panels of the face surface 14 that will serve as inboard panels or pages of the multi-page assembly 10.

At stage 418, one or more deposits of cohesive 46 are disposed longitudinally on the back surface 15 adjacent each of the first and the second side edges 16 and 18, and one or more deposits of cohesive 48 are disposed transversely on the back surface 15 adjacent each of the first and the second transverse edges 22 and 24. The longitudinal deposits of cohesive 46 and the transverse deposits of cohesive 48 outline a perimeter of the back surface 15 and the panels A', B', C', D', E' and F' that will served as inboard panels of the assembly 10.

At stage 420, one or more deposits of cohesive 50 are disposed transversely on the back surface 15 on either side or on both sides of the cross fold perforations 50.

At stage 422, the sheet 12 is folded along the cross fold perforations 26 to align the perforations 28, 32 and 36 and the deposits of cohesive 46, 48 and 50 of the back surface 15 disposed along the right side of the cross fold perforations 26 with the perforations 28, 32, 36 and the cohesive deposits 46, 48 and 50 of the back surface 15 disposed along the left side of the cross fold perforations 26.

At stage 424, the sheet 12 is folded, e.g., into a Z-fold, C-fold, eccentric C-fold, V-fold or double parallel-fold configuration, along the longitudinal fold lines 28 to align the tear-off perforations 32 and 36 and to align the deposits of cohesive 42 and 44 along the face surface 14 to form the folded assembly 10.

At stage 426, the folded assembly 10 is pressure-sealed by any method well known in the art for applying pressure to the assembly 10 to activate the cohesive deposits 42, 44, 46, 48 and 50 and to thereby bind or adhere the folded portions of the folded assembly 10 by pressure-sealing.

Figure 17:
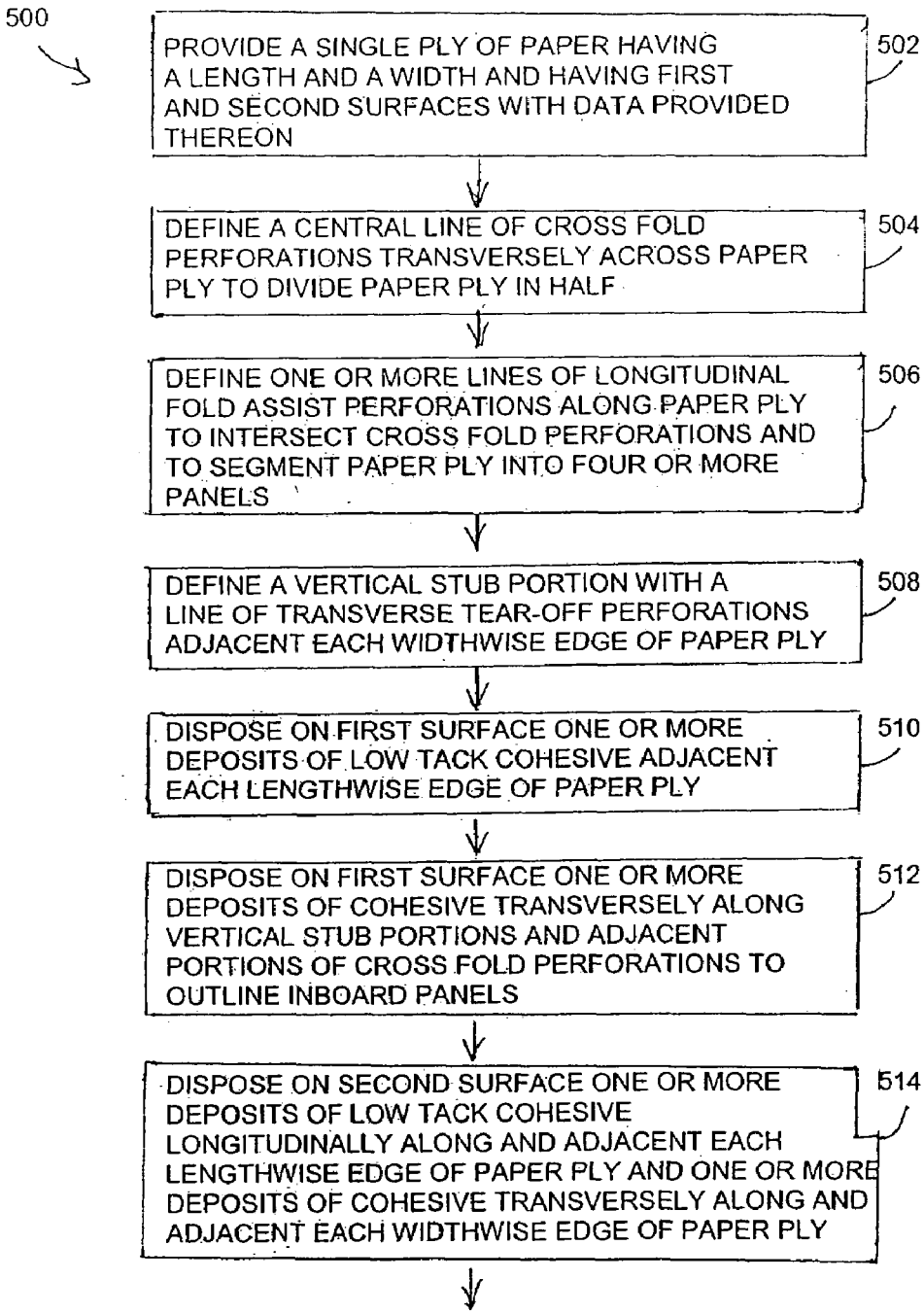
FIGS. 17-17A provide a block flow diagram illustrating a process of forming a sealed multi-page paper assembly according to a second embodiment of the invention.
Figure 17A:
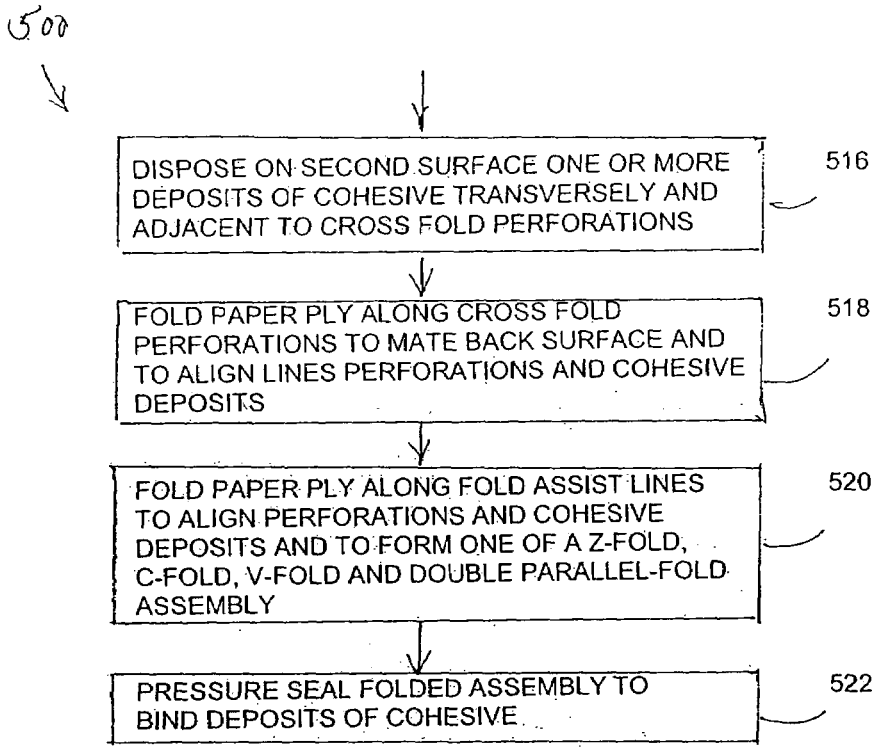

Referring to FIGS. 17-17A, a further aspect of the invention provides a process 500 for constructing the sealed, multi-page paper assembly 10 by folding and sealing a single ply or sheet of paper 12, wherein the assembly 10 is an unsecured assembly with low tack cohesive used to adhere portions of the paper 12 adjacent the first and the second side edges 16 and 18 and one of the transverse edges 22 and 24. Such an unsecured assembly permits outboard and inboard panels to be pulled or peeled apart from each other to open the assembly 10 and the pages 70 contained therein. The process 500, however, is exemplary only and not limiting. The process 500 can be altered, e.g., by having stages added, removed or rearranged.

At stage 502, the single ply or sheet of paper 12 is provided having the face surface 14 and the back surface 15 and defining a length $L_1$ and a width $W_1$, wherein the face and the back surfaces 14 and 15 have printed, imaged, handwritten and/or otherwise disposed thereon data and information to be provided to an end user.

At stage 504, the central transverse line of cross fold perforations 26 is defined in the face surface 14 and extends partially or entirely through the sheet 12 to the back surface 15 such that the cross fold perforations 26 on each surface 14 and 15 are aligned and opposite to each other, and parallel to each of the first and the second transverse edges 22 and 24. The transverse line of cross fold perforations 26 is defined in about the middle of the sheet 12, e.g., to separate the sheet 12 into two halves including a left side and a right side. In one embodiment, each half has equal dimensions to the other half.

At stage 506, one or more longitudinal lines of fold assist perforations 28 are defined in the face surface 14 and extend partially or entirely through the sheet 12 to the back surface 15 such that the lines of fold assist perforations 28 intersect the cross fold perforations 26 and segment the face surface 14 and the back surface 15 into four or more panels.

At stage 508, vertical stub portions 30, e.g., having a width $W_3$ of about 0.5 inches, are defined in the face surface 14 along each of the first and the second transverse edges 22 and 24 by a transverse line of tear-off perforations 32 defined adjacent and parallel to the first and the second transverse edges 22 and 24 and extending partially or entirely through the sheet 12 to the back surface 15.

At stage 510, one or more deposits of low tack cohesive 42 are disposed longitudinally on the face surface 14 adjacent each of the first and the second side edges 16 and 18 and/or along those panels A, B, C, D, E and F that will serve as inboard panels or pages 70 of the multi-page assembly 10.

At stage 512, one or more deposits of cohesive 44 are disposed transversely on the face surface 14 adjacent the vertical tear-off perforations 32 and adjacent and parallel to the cross fold perforations 26. The transverse deposits of cohesive 44 outline one or more panels of the face surface 14 that will serve as inboard panels or pages of the multi-page assembly 10.

At stage 514, one or more deposits of low tack cohesive 46 are disposed longitudinally on the back surface 15 adjacent each of the first and the second side edges 16 and 18, and one or more deposits of cohesive 48 are disposed transversely on the back surface 15 adjacent each of the first and the second transverse edges 22 and 24. The longitudinal deposits of low tack cohesive 46 and the transverse deposits of cohesive 48 outline a perimeter of the back surface 15 and the panels A', B', C', D', E' and F' that will served as inboard panels of the assembly 10.

At stage 516, one or more deposits of cohesive 50 are disposed transversely on the back surface 15 on either side or on both sides of the cross fold perforations 50.

At stage 518, the sheet 12 is folded along the cross fold perforations 26 to align the perforations 28, 32 and 36 and the deposits of cohesive 46, 48 and 50 of the back surface 15 disposed along the right side of the cross fold perforations 26 with the perforations 28, 32, 36 and the cohesive deposits 46, 48 and 50 of the back surface 15 disposed along the left side of the cross fold perforations 26.

At stage 520, the sheet 12 is folded, e.g., into a Z-fold, C-fold, eccentric C-fold, V-fold or double parallel-fold configuration, along the longitudinal fold lines 28 to align the tear-off perforations 32 and 36 and to align the deposits of cohesive 42 and 44 along the face surface 14 to form the folded assembly 10.

At stage 522, the folded assembly 10 is pressure-sealed by any method well known in the art for applying pressure to the assembly 10 to activate the cohesive deposits 42, 44, 46, 48 and 50 and to thereby bind or adhere the folded portions of the folded assembly 10 by pressure-sealing.

Other embodiments are within the scope and spirit of the claims. For example, the assembly 10 as shown and described in connection with FIGS. 3 and 4 can include a single line of fold assist perforations 28 to intersect the cross fold perforations 26 and to segment the sheet 12 into four panels, e.g., A and B panels defined on the left side of the cross fold perforations 26 and C and D panels defined on the right side to form a C-fold or an eccentric C-fold configuration. The longitudinal and transverse deposits of pressure-activated cohesive 42 and 44 are disposed on the face sheet 14 such that the deposits 42 and 44 outline the C panel and the D panel. When the sheet 12 to be folded along the cross fold perforations 26 such that the halves of the back surface 15 mate and the lines of perforations 32 and 36 and the deposits of cohesive 46, 48 and 50 align, the fold assist perforations 28 can further fold portions of the face sheet 14 together in a manner of a C-fold or an eccentric C-fold configuration, aligning the lines of perforations 32 and 36 and the deposits of cohesive 42 and 44 to achieve a C-fold or eccentric C-fold assembly 10.

Having thus described at least one aspect or embodiment of the invention, various alterations, modifications and improvements will readily occur to those skilled in the art. Such alterations, modifications and improvements are intended to be within the scope and spirit of the invention. Accordingly, the foregoing description is by way of example only and is not intended to be limiting.

What is claimed is:

1. A mailer intermediate for forming a secure Z-fold multi-page mailer comprising:

a single ply or sheet of paper defining a square or a rectangular configuration with a first and a second surface and having a first and a second longitudinal (lengthwise) side edge, the side edges being substantially parallel to one another, and a first and a second transverse (widthwise) end edge, the end edges being substantially parallel to one another;

a center transverse fold line bisecting and extending between the first and the second longitudinal side edges and being substantially parallel to the first and the second transverse end edges;

a first and a second longitudinal fold line bisecting and extending between the first and the second transverse end edges and being spaced from and substantially parallel to one another and the first and the second longitudinal side edges;

the center transverse fold line and the first and the second longitudinal fold lines defining the single ply or sheet into six panels including a first, a second, and a third panel defined to the left of the center transverse fold line and a fourth, a fifth, and a sixth panel defined to the right of the center transverse fold line;

a first and a second vertical stub portion disposed adjacent the first and the second transverse end edges, respectively, each vertical stub portion being defined between the transverse end edge and a line of weakness bisecting and extending between the first and the second longitudinal side edges, and a first and a second horizontal stub portion disposed adjacent the first and the second longitudinal side edges, respectively, each horizontal stub portion being defined between the longitudinal side edge and a line of weakness bisecting and extending between the first and the second transverse end edges;

a first pair and a second pair of parallel longitudinal lines of weakness bisecting and extending between the first and the second transverse end edges and disposed such that the first longitudinal fold line is positioned between and substantially parallel to the first pair of longitudinal lines of weakness and the second longitudinal fold line is positioned between and substantially parallel to the second pair of longitudinal lines of weakness;

a first plurality of adhesive or cohesive patterns disposed on the first surface and surrounding the first and the second panels along the first vertical stub portion, along the first horizontal stub portion, to the left of the central transverse fold line, and adjacent the second longitudinal fold line adjacent the second panel;

a second plurality of adhesive or cohesive patterns disposed on the first surface and surrounding the fifth and the sixth panels along the second vertical stub portion, along the second horizontal stub portion, to the right of the central transverse fold line, and adjacent the first longitudinal fold line adjacent the fifth panel;

a third plurality of adhesive or cohesive patterns disposed on the second surface along the first and the second horizontal stub portions and along the first and the second vertical stub portions;

a fourth plurality of adhesive or cohesive patterns on the second surface immediately adjacent and to the left and to the right of the central transverse fold line, the patterns being transverse and substantially parallel to the central transverse fold line; and the single ply or sheet being configured to fold along the central transverse fold line such that the third and the fourth plurality of adhesive or cohesive patterns disposed to the left of the central transverse fold line align and mate with the corresponding third and fourth plurality of adhesive or cohesive patterns disposed to the right of the central transverse fold line, and thereafter to Z-fold the first and the second panels in face-to face relation such that corresponding adhesive or cohesive patterns of the first plurality align and mate and the fifth and the sixth panels are in face-to-face relation such that corresponding adhesive or cohesive patterns of the second plurality align and mate to form the Z-fold multi-page mailer.

2. The intermediate of claim 1, further comprising a first pair of parallel transverse lines of weakness disposed along the second and the fourth panels between the first and the second pairs of longitudinal fold lines such that a portion of the center transverse fold line is disposed therebetween.

3. The intermediate of claim 1, further comprising a first singular transverse line of weakness disposed alone the first panel to the left of the central transverse fold line between the line of weakness defining the first horizontal stub portion and the first pair of parallel longitudinal lines of weakness.

4. The intermediate of claim 1, further comprising a second singular transverse line of weakness disposed along the sixth panel to the right of the central transverse fold line between the line of weakness defining the second horizontal stub portion and the second pair of parallel longitudinal lines of weakness.

5. The intermediate of claim 1, wherein the third and the fourth panels along the first surface serve as outboard panels and are disposed along the exterior of the Z-fold multi-page mailer when the mailer intermediate is Z-folded.

6. The intermediate of claim 5, wherein the first, the second, the fifth, and the sixth panels along the first surface serve as inboard panels and are disposed along the interior of the Z-fold multi-page mailer when the mailer intermediate is Z-folded.

7. A mailer intermediate for forming an unsecured Z-fold multi-page mailer comprising:

a single ply or sheet of paper defining a square or a rectangular configuration with a first and a second surface and having a first and a second longitudinal (lengthwise) side edge, the side edges being substantially parallel to one another, and a first and a second transverse (widthwise) end edge, the end edges being substantially parallel to one another;

a center transverse fold line bisecting and extending between the first and the second longitudinal side edges and being substantially parallel to the first and the second transverse end edges;

a first and a second longitudinal fold line bisecting and extending between the first and the second transverse end edges and being spaced from and substantially parallel to one another and the first and the second longitudinal side edges;

the center transverse fold line and the first and the second longitudinal fold lines defining the single ply or sheet into six panels including a first, a second, and a third panel defined to the left of the center transverse fold line and a fourth, a fifth, and a sixth panel defined to the right of the center transverse fold line;

a first and a second vertical stub portion disposed adjacent the first and the second transverse end edges, respectively, each vertical stub portion being defined between the transverse end edge and a line of weakness bisecting and extending between the first and the second longitudinal side edges;

a first plurality of adhesive or cohesive patterns disposed on the first surface and surrounding the first and the second panels along the first vertical stub portion, to the left of the central transverse fold line, adjacent the first longitudinal side edge, and adjacent the second longitudinal fold line, the adhesive or cohesive patterns disposed adjacent the first longitudinal side edge and the second longitudinal fold line comprising low-tack adhesive or cohesive;

a second plurality of adhesive or cohesive patterns disposed on the first surface and surrounding the fifth and the sixth panels along the second vertical stub portion, to the right of the central transverse fold line, adjacent the second longitudinal side edge and adjacent the first longitudinal fold line, the adhesive or cohesive patterns disposed adjacent the second longitudinal side edge and the first longitudinal fold line comprising low-tack adhesive or cohesive;

a third plurality of adhesive or cohesive patterns disposed on the second surface adjacent the first and the second longitudinal side edges and along the first and the second vertical stub portions, the adhesive of cohesive patterns disposed adjacent the first and the second longitudinal side edges comprising low-tack adhesive or cohesive;

a fourth plurality of adhesive or cohesive patterns on the second surface immediately adjacent and to the left and to the right of the central transverse fold line, the patterns being transverse and substantially parallel to the central transverse fold line; and the single ply or sheet being configured to fold along the central transverse fold line such that the third and the fourth plurality of adhesive or cohesive patterns disposed to the left of the central transverse fold line align and mate with the corresponding third and fourth plurality of adhesive or cohesive patterns disposed to the right of the central transverse fold line, and thereafter the single ply or sheet is Z-folded such that the first and the second panels are in face-to-face relation and corresponding adhesive or cohesive patterns of the first plurality align and mate and the fifth and the sixth panels are in face-to-face relation and corresponding adhesive or cohesive patterns of the second plurality align and mate to form the Z-fold multi-page mailer.

8. The intermediate of claim 7, further comprising a first pair of parallel transverse lines of weakness disposed along the second and the fourth panels between the first and the second longitudinal fold lines such that a portion of the center transverse fold line is disposed therebetween.

9. The intermediate of claim 7, further comprising a first singular transverse line of weakness disposed along the first panel to the left of the central transverse fold line between the first longitudinal side edge and the first longitudinal fold line.

10. The intermediate of claim 9, further comprising a second singular transverse line of weakness disposed along the sixth panel to the right of the central transverse fold line between the second longitudinal side edge and the second longitudinal fold line.

11. The intermediate of claim 7, wherein the third panel and the fourth panel along the first surface serve as outboard panels and are disposed along the exterior of the Z-fold multi-page mailer when the mailer is Z-folded.

12. The intermediate of claim 11, wherein the first, the second, the fifth, and the sixth panel along the first surface serve as inboard panels and are disposed along the interior of the Z-fold multi-page mailer when the mailer is Z-folded.

* * * * *